US005379608A

United States Patent [19]

Ishimaru et al.

[11] Patent Number: 5,379,608

[45] Date of Patent: Jan. 10, 1995

[54] DEFROSTING CONTROL UNIT FOR SHOWCASES

[75] Inventors: Keiichi Ishimaru; Osamu Itoh; Tomoyoshi Nakatani; Haruhiko Sudo; Masaya Kurita, all of Kawasaki, Japan

[73] Assignee: Fuji Electric Co., Ltd., Kawasaki, Japan

[21] Appl. No.: 35,151

[22] Filed: Mar. 22, 1993

[30] Foreign Application Priority Data

Mar. 24, 1992 [JP] Japan ..... 4-097277
Jul. 1, 1992 [JP] Japan ..... 4-199225

[51] Int. Cl.[6] ..... F25D 21/06

[52] U.S. Cl. ..... 62/155; 62/156; 62/234

[58] Field of Search ..... 62/155, 151, 156, 234, 62/176.2, 140, 157, 158

[56] References Cited

U.S. PATENT DOCUMENTS 4,395,887 8/1983 Sweetman ..... 62/234 X
5,167,365 12/1992 Mitoshi et al. ..... 62/157 X

FOREIGN PATENT DOCUMENTS 51-95643 8/1976 Japan .
57-87550 6/1982 Japan ..... 62/156
60-38544 2/1985 Japan ..... 62/156
61-161380 7/1986 Japan .
2-197785 8/1990 Japan .
3-48434 7/1991 Japan .

*Primary Examiner*—Harry B. Tanner
*Attorney, Agent, or Firm*—Spencer, Frank & Schneider

[57] ABSTRACT

A defrosting control unit for providing centralized control of the defrosting a showcase having showcase units with defrosting devices includes an environmental informer ion signal generation portion and a defrosting control portion. The signal generation portion generates a signal reflecting at least one environmental parameter such as whether it is daytime or nighttime, the difference in air temperature measured at different places in a showcase unit, the deviation of the temperature difference with respect to a steady-state value, and the temporal variation of the deviation. The defrosting control portion receives the environmental information signal from the signal generation portion and sends a defrosting start signal and a defrosting end signal to the defrosting devices at a time interval. The signal generation portion may include a fuzzy reasoning portion, membership functions, and rules so that an inference on the optimal time for starting a defrosting operation can be made. The optimal time for starting a defrosting may also be obtained by a defrosting timer and a day/night judgment portion. A centralized showcase defrosting system includes such a defrosting centre unit in addition to a showcase unit having an inner duct, an evaporator and a defrosting device attached to the evaporator, the defrosting device having a heater for melting frost which has been deposited on the surface of the evaporator.

20 Claims, 14 Drawing Sheets

DEFROSTING CONTROL UNIT FOR SHOWCASES

BACKGROUND OF THE INVENTION

1. Field of the Invention

The present invention relates to a defrosting control unit for showcases suitable for concentrated control of defrosting of a plurality of showcases such as those used in retail stores and supermarkets marketing fresh grocery, fish, meat, etc. The present invention also relates to a centralized showcase defrosting system using such a defrosting control unit.

2. Description of the Prior Art

When a plurality of series of showcases are to be defrosted independently of another, it has been conventional to set up defrosting starting times for respective showcase series in advance and to start defrosting at the respective defrosting starting times. Defrosting starting times were selected to be in the nighttime when no or few customers were expected to be present in the store so that the defrosting would impose a minimum of inconvenience on the customers.

During continued cooling, flow of cool air tends to be blocked due to settling of frost on an evaporator portion of a cooling apparatus. This phenomenon is called clogging. Defrosting is carried out in order to avoid the occurrence of clogging.

The conventional defrosting method, however, suffers from limitations on the time interval for defrosting because of the performance of the showcase, and hence defrosting must be done at least once during the daytime when many customers are shopping in the store. Defrosting results an increase in the temperature of the showcase, and this spoils the purchasing volition of customers who want to get goods as fresh as possible.

Conventionally, the time interval for defrosting has been set up rather short for safety. As a consequence, defrosting will start even if only a small amount of frost has settled on the evaporator when the set-up time is reached. Therefore, problems arise in that the freshness of goods decreases rapidly due to an unnecessary increase in the temperature in the showcase, and in that power is consumed by a heated excessively or in vain.

SUMMARY OF THE INVENTION

Therefore, an object of the present invention is to solve the aforementioned problems and provide an apparatus for controlling the defrosting of showcases, which apparatus drives a defrosting device at an optimal timing selected in response to the situation of the showcase such as the state of the defrosting on an evaporator, and so on, and which saves power and has an improved ability to keep goods fresh.

According to a first aspect of the present invention, there is provided a defrosting control unit for a showcase having a defrosting device, comprising: an environmental information signal generation portion which generates a signal reflecting at least one environmental parameter; and a defrosting control portion which receives the environmental information signal from the environmental information signal generation portion and sends a defrosting start signal and a defrosting end signal to the defrosting devices.

Here, the showcase may have provided therein an inner duct for circulating air, an evaporator provided in the inner duct and for cooling the air circulating in the inner duct, a defrosting device attached to the evaporator and having heating means for melting frost which has been deposited on the evaporator, and the defrosting control unit may further comprise a showcase controller connected to the heating means, and driving the heating means upon receipt of the defrosting start signal and terminating the action of the heating means upon receipt of the defrosting end signal.

The environmental information signal generation portion may comprises a fuzzy reasoning portion; membership functions; and rules; the fuzzy reasoning portion inferring an optimal timing for starting a defrosting operation based on the at least one environmental parameter and using the membership functions and the rules.

The environmental information signal generation portion may comprise a day/night judgment portion which receives the environmental information signal from the fuzzy reasoning portion and judges whether it is daytime or nighttime when the environmental information signal is issued; and the defrosting control portion comprises a simple defrosting control portion and a regular defrosting control portion; the day/night judgment portion sending a simple defrosting control signal to the simple defrosting control portion when it is daytime and sending a regular defrosting control signal to the regular defrosting control unit when it is nighttime.

The aforementioned defrosting control units may further comprise: a first temperature sensor for detecting a first air temperature of air blown out from an inner duct; a second temperature sensor for detecting a second air temperature of air immediately after passing the evaporator; an air temperature difference computing portion which receives a data on the first temperature from the computes the air temperature difference between the first and second air temperatures; a stable-state value renewal and store portion which calculates an average of the air temperature difference during a stable period between completion of defrosting and frosting after the completion of defrosting after each defrosting action, and renews and stores the average as a stable-state value; a deviation computing portion which receives a data on the air temperature difference from the air temperature difference computing portion and computes a deviation of the air temperature difference with respect to the stable-state value; and a variation computing portion which receives data on the deviation of the air temperature difference and calculates a temporal variation of the deviation.

The defrosting control units may further comprise: a post-defrosting time counter which counts the time that has passed from the previous defrosting operation; and a time difference computing portion which computes the time difference between the post-defrosting time and a past defrosting time interval that has been stored.

The defrosting control units may further comprise: a third temperature sensor for detecting the open air temperature; a humidity sensor for detecting the open air humidity; a defrosting time interval computing portion which calculates an optimal defrosting time interval and a marginal defrosting time interval from the open air temperature and the open air humidity; and means for deeming the optimal defrosting time interval as a past defrosting time interval result in the absence of the past defrosting time interval result.

The environmental information signal generation portion in the aforementioned defrosting control units may comprise a defrosting timer which issues an environmental information signal at a predetermined time; a day/night judgment portion which receives the environmental information signal from the defrosting timer and judges whether it is daytime or nighttime when the environmental information signal is issued; and the defrosting control portion comprises a simple defrosting control portion and a regular defrosting control portion; the day/night judgment portion sending a simple defrosting control signal to the simple defrosting control portion when it is daytime and a regular defrosting control signal to the regular defrosting control unit when it is nighttime; the simple defrosting control unit sending a defrosting start signal to the showcase controller upon receipt of the simple defrosting control signal and then sending a defrosting compulsive end signal to the showcase controller at a first time interval during which substantially no increase in temperature occurs to terminate a defrosting operation compulsively; and the regular defrosting control portion sending a defrosting start signal to the showcase controller upon receipt of the regular defrosting control signal and then a defrosting compulsive end signal to the showcase controller at a second time interval during which sufficient defrosting occurs and there is no excessive increase in temperature.

According to a second aspect of the present invention, there is provided a centralized showcase defrosting system comprising: a showcase; an inner duct for circulating therethrough air for cooling the showcase; an evaporator provided in the inner duct for cooling the air circulating through the inner duct, a defrosting device attached to the evaporator and having heating means for melting frost which has been deposited on the surface of the evaporator, and a defrosting control unit including: an environmental information signal generation portion which generates a signal reflecting at least one environmental parameter; and a defrosting control portion which receives the environmental information signal from the environmental information signal generation portion and sends a defrosting start signal and a defrosting end signal to the defrosting devices.

Here, the showcase may have provided therein an inner duct for circulating air, an evaporator provided in the inner duct for cooling the air circulating in the inner duct, a defrosting device attached to the evaporator and having heating means for melting frost which has been deposited on a surface of the evaporator, and the defrosting control unit may further comprise a showcase controller connected to the heating means, and driving the heating means upon receipt of the defrosting start signal and terminating the action of the heating means upon receipt of the defrosting end signal .

The environmental information signal generation portion may comprise: a fuzzy reasoning portion; membership functions; and a rules; the fuzzy reasoning portion inferring an optimal timing for starting a defrosting operation based on the at least one environmental parameter and using the membership functions and the rules.

The environmental information signal generation portion may comprise a day/night judgment portion which receives the environmental information signal from the fuzzy reasoning portion and judges whether it is daytime or nighttime when the environmental information signal is issued; and the defrosting control portion comprises a simple defrosting control portion and a regular defrosting control portion; the day/night judgment portion sending a simple defrosting control signal to the simple defrosting control portion when it is daytime and sending a regular defrosting control signal to the regular defrosting control unit when it is nighttime.

The aforementioned defrosting control units may further comprise: a first temperature sensor for detecting a first air temperature of air blown out from an inner duct; a second temperature sensor for detecting a second air temperature of air immediately after passing the evaporator; an air temperature difference computing portion which computes the air temperature difference between the first and second air temperatures; a stable-state value renewal and store portion which calculates an average of the air temperature difference during a stable period between completion of defrosting and frosting after the completion of defrosting after each defrosting action, and renews and stores the average as a stable-state value; deviation computing portion which receives data on the air temperature difference from the Air temperature difference computing portion and computes a deviation of the air temperature difference with respect to the stable-state value; and a variation computing portion which receives data on the deviation of the air temperature difference and calculates a temporal variation of the deviation.

The defrosting control units may further comprise: a post-defrosting time counter which counts time that has passed from previous defrosting operation; and a time difference computing portion which computes the time difference between the post-defrosting time and a past defrosting time interval that has been stored.

The defrosting control units may further comprise: a third temperature sensor for detecting the open air temperature; a humidity sensor for detecting the open air humidity; a defrosting time interval computing portion which calculates an optimal defrosting time interval and a marginal defrosting time interval from the open air temperature and the open air humidity; and means for deeming the optimal defrosting time interval as a past defrosting time interval result in the absence of the past defrosting time interval result.

The environmental information signal generation portion in the aforementioned defrosting control units may comprise a defrosting timer which issues an environmental information signal at a predetermined time; a day/night judgment portion which receives the environmental information signal from the defrosting timer and judges whether it is daytime or nighttime when the environmental information signal is issued; and the defrosting control portion comprises a simple defrosting control portion and a regular defrosting control portion; the day/night judgment portion sending a simple defrosting control signal to the simple defrosting control portion when it is daytime and a regular defrosting control signal to the regular defrosting control unit when it is nighttime; the simple defrosting control unit sending a defrosting start signal to the showcase controller upon receipt of the simple defrosting control signal and then sending a defrosting compulsive end signal to the showcase controller at a first time interval during which substantially no increase in temperature occurs to terminate a defrosting operation compulsively; and the regular defrosting control portion sending a defrosting start signal to the showcase controller upon receipt of the regular defrosting control signal and then a defrosting compulsive end signal to the showcase controller at a second time interval during which sufficient defrosting occurs and there is no excessive increase in temperature.

The above and other objects, effects, features and advantages of the present invention will become more apparent from the following description of embodiments thereof taken in conjunction with the accompanying drawings.

DESCRIPTION OF PREFERRED EMBODIMENTS

Figure 1:
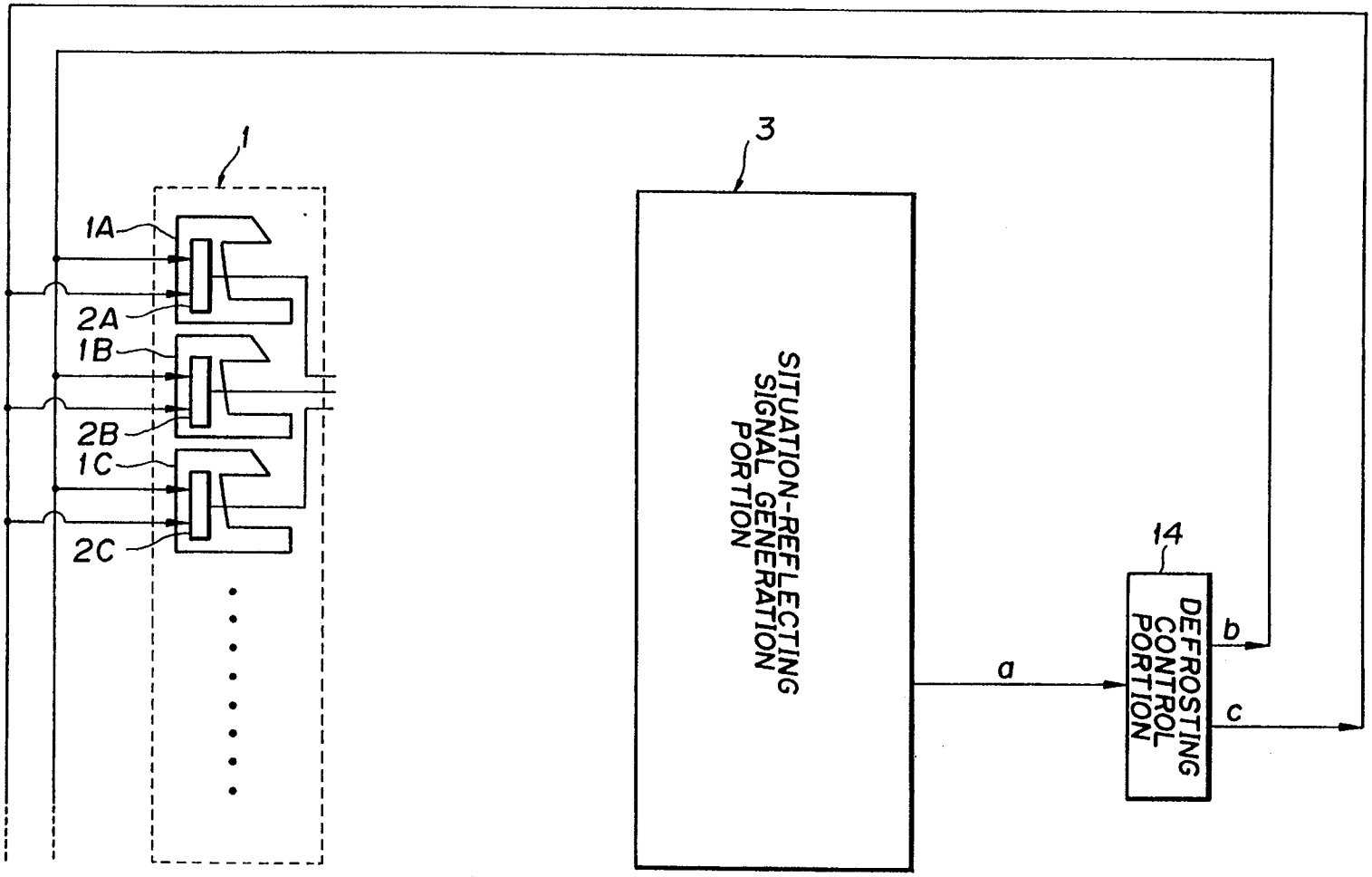
FIG. 1 is a schematic block diagram showing the basic arrangement of a defrosting control apparatus of the present invention.

FIG. 1 is a schematic block diagram showing the basic arrangement of a defrosting control unit of the present invention. In FIG. 1, reference numeral 1 denotes a showcase in which goods which need to be cooled are displayed or shown. The showcase 1 includes a plurality of showcase units 1A, 1B, 1C, . . . . The showcase units 1A, 1B, 1C, . . . are provided with showcase controllers 2A, 2B, 2C, . . . , respectively. Reference numeral 3 is a situation-reflecting (or environmental information) signal generation portion, and 14 designates a defrosting control portion. The situation-reflecting signal generation portion 3 generates an environmental information signal a which reflects at least one information or parameter among information or parameters on environmental conditions such as daytime or nighttime, temperature and humidity of the ambient open air, temperature difference or distribution in a showcase, and so on. The signal generation portion 3 sends the signal a to the defrosting control portion 4. Upon receipt of the signal a from the signal generation portion 3, the defrosting control portion 4 sends a defrosting starting signal b to each of the controllers 2A, 2B, 2C, . . . so that a heater in each of the showcase units 1A, 1B, 1C, . . . can be energized to start defrosting. After a predetermined time has lapsed, the defrosting control portion 4 sends a defrosting compulsive end signal c for terminating the defrosting operation compulsively. Defrosting is controlled in such a manner that defrosting operation can be performed in each of the controllers 2A, 2B, 2C, . . . in response to one or more selected parameters pertaining to the environment or situation . For example, the defrosting operation pattern may be varied depending on whether it is daytime or nighttime. Alternatively, the defrosting operation may be performed in a defrosting time interval or at a defrosting timing which varies depending on changes in the temperature distribution in the showcases. Further, defrosting may be performed in a suitable defrosting mode, in a suitable defrosting time interval, or at a suitable defrosting timing, taking into consideration the temperature and/or humidity of open air.

Environmental information signals which reflect environmental information or which take into consideration one or more parameters pertaining to the state of the environment can be generated preferably by using fuzzy logic or reasoning. Fuzzy reasoning infers an optimal defrosting timing or the like, by judging environmental information based on a set of membership functions and a set of rules.

The defrosting control unit of the present invention can control the defrosting operation of a defrosting device precisely and can avoid setting up a defrosting time interval that is shorter than is necessary, unlike conventional defrosting control units, thus preserving the freshness of goods and saving energy.

EXAMPLES

Hereafter, the present invention will be described in more detail by examples with reference to the accompanying drawings . However, the present invention should not be construed as being limited thereto.

Example 1

Figure 2:
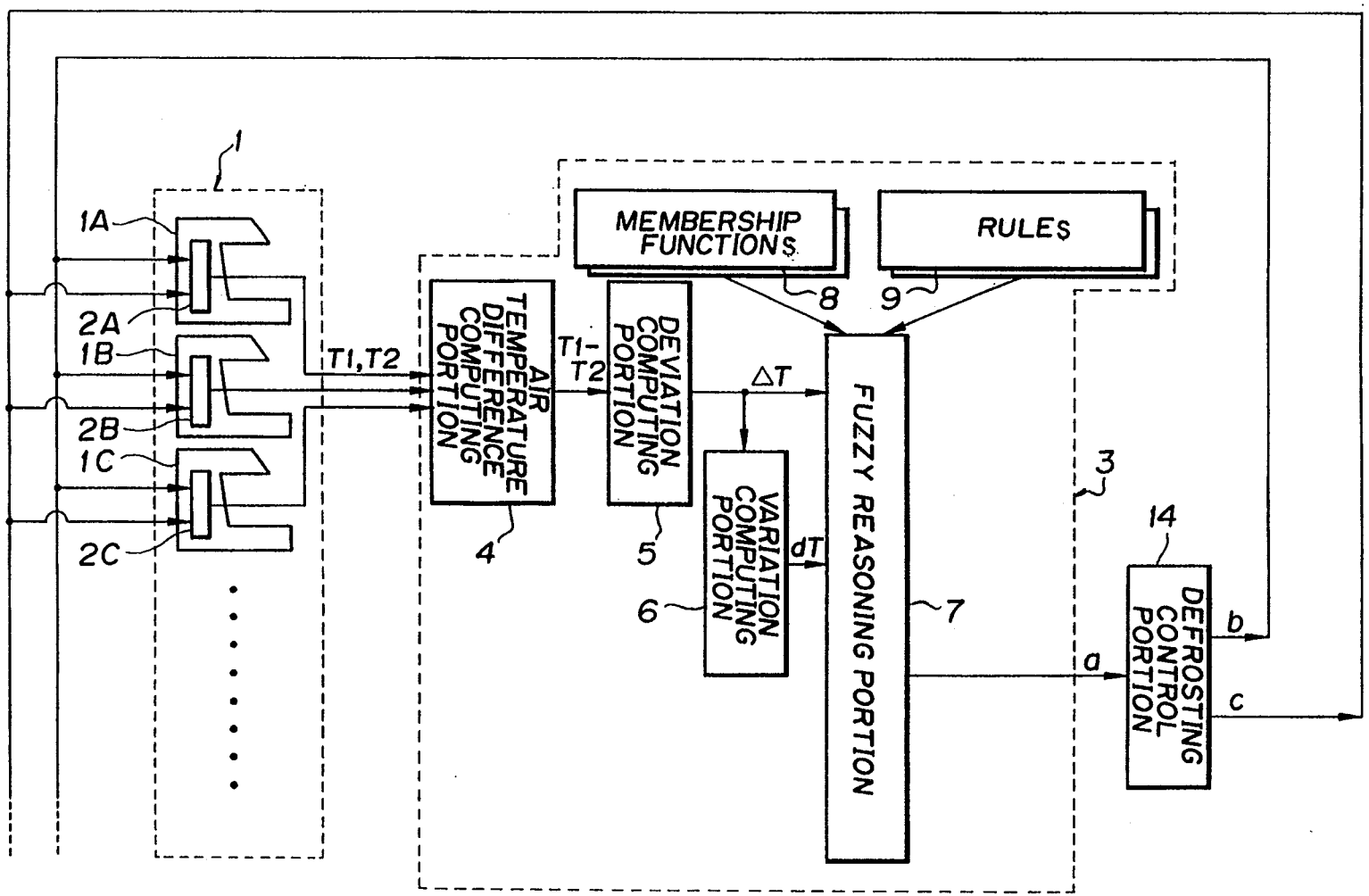
FIG. 2 is a block diagram showing the arrangement of a defrosting control unit according to a first example of the present invention.

FIG. 2 is a block diagram showing an arrangement of a defrosting control unit according to a first example of the present invention. In FIG. 2, reference numeral 1 denotes a showcase, which includes a plurality of showcase units 1A, 1B, 1C, . . . , and so on and showcase controllers, 2A, 2B, 2C, . . . and so on Reference number 3 designates a situation-reflecting (environmental information) signal generation portion, 4 designates an air temperature difference computing portion, 5 designates a deviation computing portion, 6 designates a variation computing portion, 7 designates a fuzzy reasoning portion, 8 designates membership functions, 9 designates rules, 14 designates a defrosting control portion, a designates an environmental information signal, b designates a defrosting start signal, and c designates a defrosting compulsive end signal.

Figure 3:
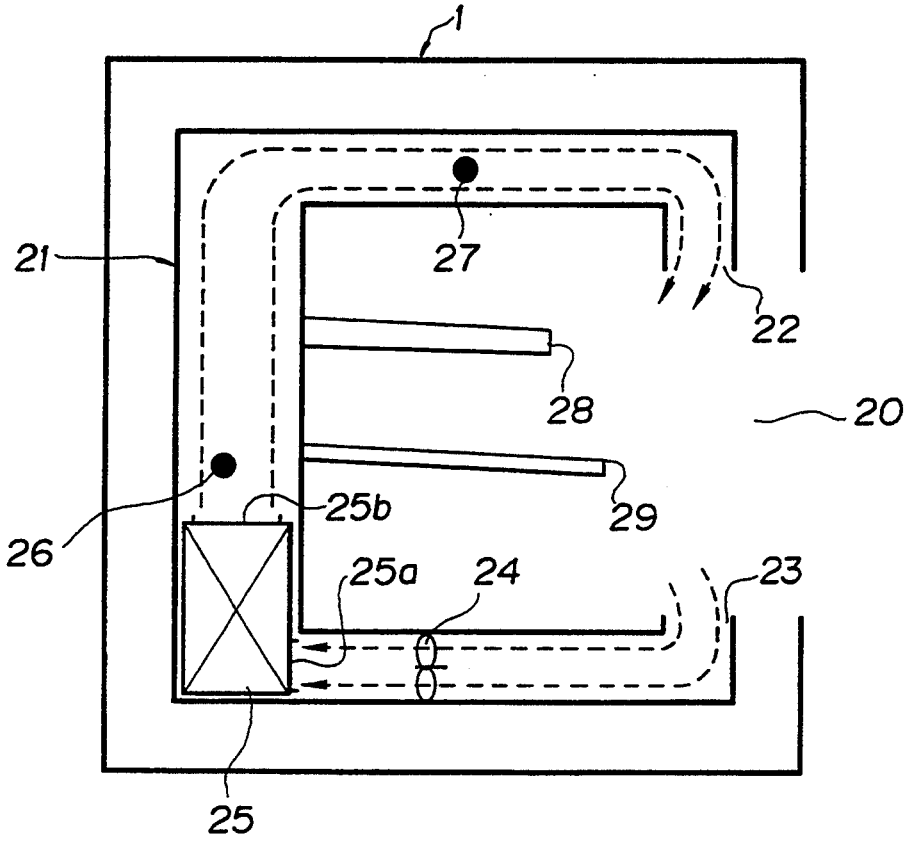
FIG. 3 is a cross sectional view showing a showcase with which the defrosting control unit according to the first example of the present invention is used.

FIG. 3 is a schematic cross sectional view showing the details of the showcase 1 shown in FIG. 2.

As shown in FIG. 3, an opening 20 is provided on the front side of the showcase 1 . Inside the opening 20, an inner duct 21 ends at an upper opening 22 and a lower opening 23. In the inner duct 21 on the intake or suck-in side thereof is arranged a fan 24 which sucks air in the showcase 1 through the lower opening 23 and sends it to an evaporator 25, which is arranged in the inner duct 21 and, for example, at a corner of the showcase 1. The evaporator has an inlet port **25*a* and an outlet port 25*b*. The air comes in the inlet port 25*a* and flows through the evaporate or 25 and comes out from the outlet port 25*b*, and air flowing through the inner duct 21 is cooled while it flows through the evaporator. The evaporator 25 has a defrosting device (not shown) which includes a heater such as an electric heater. Air cooled by the evaporator 25 is sent through the inner duct 21 to the upper opening 22 and blown out therethrough into the showcase 1. Reference numbers 28 and 29** designates shelves for showing goods.

Immediately after the outlet port **25*b* of the evaporator 25 is arranged a first temperature sensor 26. A second temperature sensor 27 is arranged downstream at a position closer to the upper opening 22**.

The showcase controllers 2A, 2B, 2C, . . . control the operations of the built-in defrosting devices (not shown), respectively, and send data concerning first and second air temperatures T1 and T2. The first air temperature T1 is the temperature of air blowing out from the upper opening 22 of the inner duct 21 detected by the temperature sensor 27 (hereinafter, referred to the inner duct blow-out air temperature) and the second air temperature T2 is the temperature of the air just after passing through the evaporator 25 detected by the temperature sensor 26 (hereinafter, referred to as the evaporator outlet air temperature). The data concerning T1 and T2 are received by the air temperature difference computing portion 4 in the situation-reflecting signal generation position 3.

The air temperature difference computing portion 4 calculates the temperature difference (T1–T2) between the first and second temperatures T1 and T2 sent from each of the showcase controllers 2A, 2B, 2C, . . . , and sends the resultant data to the deviation computing -=portion 5 .

The deviation computing portion 5 calculates a deviation $\Delta T$ of the temperature difference (T1–T2) with respect to a stable-state value $T_0$ or each of the showcase control Lets 2A, 2B, 2C, . . . , and sends the data thus obtained to the variation computing portion 6 and the fuzzy reasoning portion 7. The stable-state value $T_0$ is a fixed value obtained during regular defrosting operations (conventional defrosting). As will be explained in more detail later when a regular defrosting operation is started, the both temperatures first increase and then decrease before reaching stable states. Usually, it takes about 2 hours to reach the stable states, and thereafter the temperatures remain at fixed levels for about 1 hour before frosting begins. The temperature differences (T1–T2 ) during this stable stage are calculated for every regular defrosting operation and input, moving average of the data obtained is stored as the stable-state value $T_0$.

The variation computing portion 6 calculates a temporal variation dT of the deviation $\Delta T$, and sends the result to the fuzzy reasoning portion 7.

The fuzzy reasoning portion 7 generates and sends the defrosting control signal a to the defrosting control portion 4 only if it infers that the point in time is an optimal defrosting time by fuzzy reasoning based on various input data using the membership functions 8 and the rules 9. The operation of the fuzzy reasoning portion 7 is carried out at a predetermined time interval for each of the controllers 2A, 2B, 2C, . . . .

The membership functions 8 are used in order to judge allowability or degree of urgency before the next defrosting operation should start, or how much frost has attached to the evaporator or how much time can elapse before the next defrosting operation is carried out, based on various data input to the fuzzy reasoning portion 7, such as the deviation $\Delta T$, and its temporal variation dT, etc.

The rules 9 are is used for determining as to whether a defrosting operation is necessary or not under the input conditions. The rules 9 are made based on the technical know-how which is possessed by technical experts have who are skilled in the field of defrosting control of showcases.

The defrosting control portion 14, upon input of the defrosting control signal a, sends the defrosting start signal b to each of the showcase controllers 2A, 2B, 2C, . . . to drive the defrosting devices (not shown) such as elect tic heaters to generate or otherwise provide heat and allow defrosting to proceed. If no defrosting compulsive end signal c is input, a predetermined mode of defrosting continues to operate until a defrosting termination function provided in each of the showcase controllers 2A, 2B, 2C, . . . works as in the case of conventional defrosting. If the termination function does not work after a predetermined time from the initiation of the defrosting operation, the defrosting control portion 4 sends the defrosting compulsive end signal c to each of the showcase controllers 2A, 2B, 2C, . . . for safety to terminate the defrosting operation compulsively. The time set up here is a time long enough for regular defrosting to be completed.

The defrosting device (not shown) attached to the evaporator 25 includes an electric heater or the like. The defrosting device stops the supply of a coolant to the evaporator 25 when the defrosting operation starts and energizes the heater to generate heat so that frost on the surface of the evaporator can melt and be removed. When the defrosting operation is over, the defrosting device is automatically stooped and the ordinary cooling mode is resumed.

As described above, the defrosting control unit for showcases according to the instant example infers the amount of frost attached to the evaporator and a time allowance for the next defrosting to be performed by fuzzy reasoning using knowledge obtained by technical experts in the field of defrosting of showcases the fuzzy reasoning is based on various data such as the deviation ΔT, and its temporal variation dT, and realizes optimal control of defrosting devices.

Example 2

Figure 4:
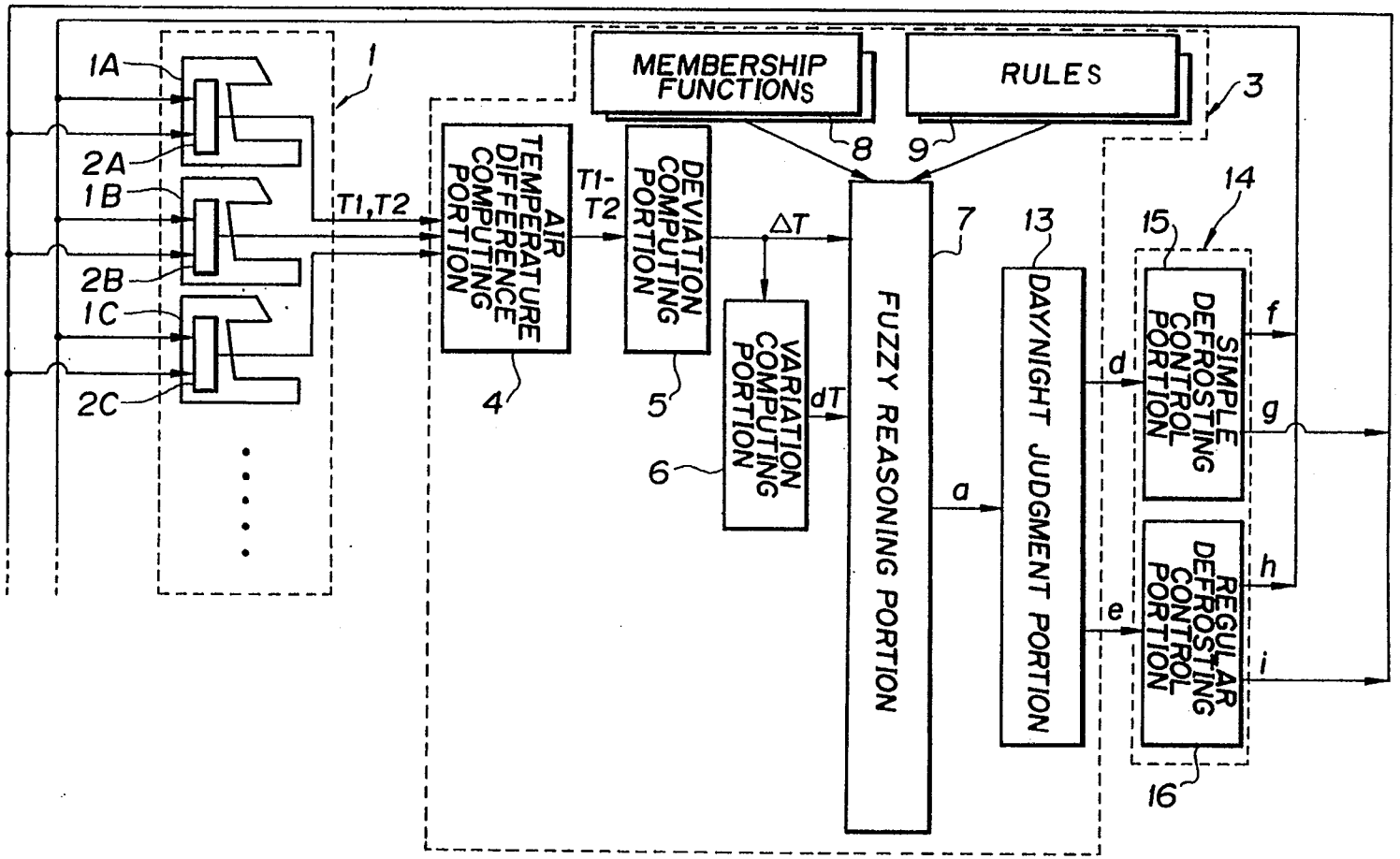
FIG. 4 is a block diagram showing the arrangement of a defrosting control unit according to a second example of the present invention.

FIG. 4 is a block diagram showing a defrosting control unit for showcases according to a second example of the present invention.

The defrosting control unit according to this example has the same arrangement as the first example shown in FIGS. 2 and 3 except that the situation-reflecting (environmental information) signal generation portion 3 includes a day/night judgment portion 13, an the defrosting control portion 14 comprises a first Dr simple defrosting control unit 15 and a second or regular defrosting control portion 16. Reference numerals 1A, 1B, 1C, . . . , 2A, 2B, 2C, . . . , and 3 to 8 are the same as those shown in FIG. 2.

In this example, the rules 9 comprises two types of rules, one for daytime, and the other for nighttime similar to but not identical to those presented hereafter in Tables 1 and 2, respectively.

In the same manner as in Example 1, temperature sensors 26 and 27 (FIG. 3) detect temperatures T1 and T2, and the data are sent to the temperature difference computing portion 4, which calculates the air temperature difference (T1–T2). This data is sent to the deviation computing portion 5. The deviation computing portion 5 sends the deviation ΔT of the air temperature difference to the variation computing portion 6, which calculates the temporal variation dT of the deviation ΔT, and sends the result, dT, to the fuzzy reasoning portion 7.

The fuzzy reasoning portion 7 infers whether it is an optimal time to start, considering the data input therein by, fuzzy reasoning based on the membership functions 8 and the rules 9, and sends the environmental information signal a to the day/night judgment portion 13 only if an inference is made that the present time is an optimal time to start a defrosting operation. The inference action of the fuzzy reasoning portion 7 occurs at a predetermined time interval for each of the controllers 2A, 2B, 2C, . . . .

The membership functions 8 are used to judge the time allowance or degree of urgency before the next defrosting should be done, or how much frost has attached to the evaporator or how much time can elapse before the next frosting, based on various input data to the fuzzy reasoning portion 7, including the deviation ΔT, and its temporal variation dT. In this example, two different sets of membership functions are used one for daytime and the other for nighttime.

The rules 9 are a set of rules which are applied when the fuzzy reasoning portion 7 infers that defrosting is necessary based on the conditions or data input to the fuzzy reasoning portion 7. Two groups of rules are stored, one for daytime and the other for nighttime. These rules are prepared based on know-how on defrosting control which a skilled artisan in the field of defrosting of showcases has.

Upon input of the environmental information signal a, the day/night judgment portion 13 judges whether it is daytime or nighttime when the signal is issued, and sends a simple defrosting control signal d to the simple defrosting control portion 15 if it is daytime, and if it is nighttime a, it sends a regular defrosting control signal e to the regular defrosting control portion 16.

Upon receipt of a simple defrosting control signal d, the simple defrosting control portion 15 sends a defrosting start signal f to each of the controllers 2A, 2B, 2C, . . . to start a defrosting operation in each of the showcases 1A, 1B, 1C, . . . , and then it sends a defrosting compulsive end signal g to each of the controllers 2A, 2B, 2C, . . . after a short time within a time interval during which the temperature of each showcase does not increase substantially despite the defrosting operation.

When it receives a regular defrosting control signal e, the regular defrosting control portion 16 sends a defrosting start signal h to each of the controllers 2A, 2B, 2C, . . . to start a defrosting operation. After a predetermined time has elapsed from the onset of the defrosting operation, the regular defrosting control portion 16 sends a defrosting compulsive end signal i to each of the controllers 2A, 2B, 2C, . . . to compulsively end the defrosting operation for safety. The time interval between the issuance of the regular defrosting start signal h and the issuance of the defrosting compulsive end signal i is set up to be long enough for ordinary regular defrosting to be concluded.

The controllers 2A, 2B, 2C, . . . , upon receipt of defrosting start signals f and h, respectively, drive defrosting devices (not shown) such as electric heaters simultaneously to start a defrosting operation. Thereafter, upon input of a defrosting compulsive end signal g, each of the controllers 2A, 2B, 2C, . . . stops the defrosting operation even though the defrosting has not been completed, and switches over to the ordinary cooling operation. This type of defrosting is simple defrosting which is performed in the daytime.

When no defrosting compulsive end signal g is input to the controllers 2A, 2B, 2C, . . . , a predetermined defrosting operation will be continued until respective defrosting termination functions provided with the control Lets 2A, 2B, 2C, . . . start to operate. If such defrosting termination functions do not start to operate after a predetermined time from the initiation of the defrosting, the defrosting operation is terminated compulsively by a defrosting compulsive end signal i sent to the controllers 2A, 2B, 2C, . . . at that point in time. This type of defrosting operation is a regular defrosting operation which is performed in the nighttime.

In this example, a defrosting operation will be practiced compulsively when it is a standard time for defrosting, and hence the rules 9 includes a rule that defrosting is cut off if it is close to a standard time.

As described above, the defrosting control unit for showcases according to the instant example infers the amount of frost which has settled on the evaporator and a time allowance for the next defrosting to be performed by fuzzy reasoning using knowledge obtained by technical expert s in the field of defrosting of showcases based on various data such as the deviation ΔT, and its temporal variation dT, and realizes optimal control of defrosting devices.

Example 3

Figure 5:
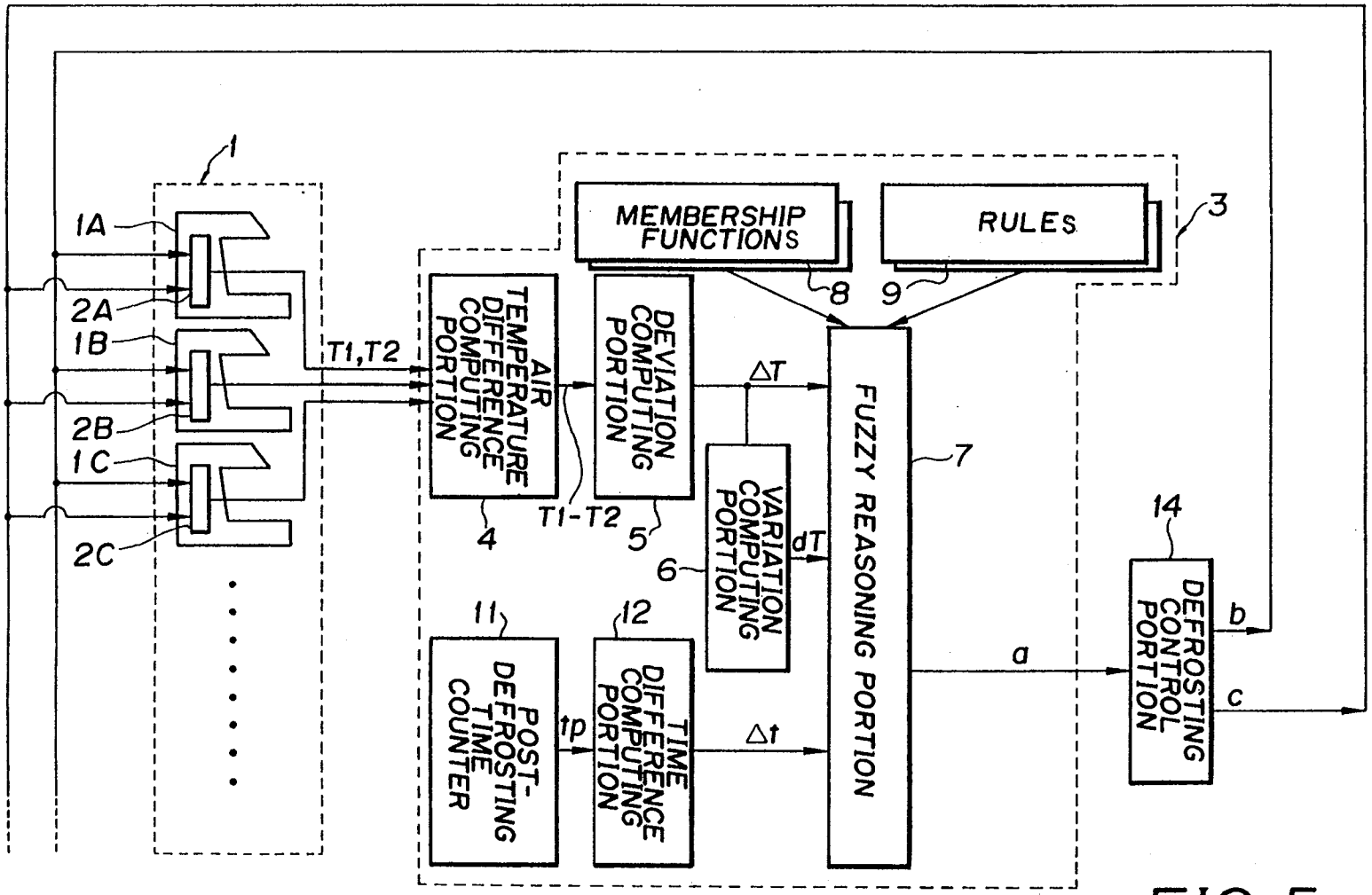
FIG. 5 is a block diagram showing the arrangement of a defrosting control unit according to a third example of the present invention.

FIG. 5 is a block diagram showing a defrosting control unit for showcases according to a third example of the present invention.

The defrosting control unit according to this example has the same arrangement as the first example shown in FIGS. 2 and 3 except that the situation-reflecting signal generation portion 3 includes a post-defrosting time counter 11 and a time difference computing portion 12. Reference numerals 1A, 1B, 1C, . . . , 2A, 2B, 2C, . . . , and 3 to 8 are the same as those shown in FIG. 2.

In the same manner as in Example 1, temperature sensors 26 and 27 (FIG. 3) detect temperatures T1 and T2, and the data are sent to the temperature difference computing portion 4. The temperature difference computing portion 4 calculates the air temperature difference (T1–T2) and sends this data to the deviation computing portion 5. The deviation computing portion 5 sends the deviation ΔT of the air temperature difference to the variation computing portion 6. This calculates the temporal variation dT of the deviation ΔT, and sends the result, dT, to the fuzzy reasoning portion 7.

On the other hand, the post-defrosting time counter 11 counts the time tp which has passed from completion of the previous defrosting operation, and sends this data to the time difference computing portion 12.

The time difference computing portion 12 calculates the time difference Δt between the time lapse tp and a standard defrosting time interval $t_0$, and sends the result to the fuzzy reasoning portion 7. The standard defrosting time interval $t_0$ is obtained as a moving average of previously used defrosting time intervals. For the initial run, a conventional defrosting time interval to may be used as the standard defrosting time interval $t_0$.

The fuzzy reasoning portion 7 infers an optimal time to start a defrosting operation based on the input data by fuzzy reasoning using the membership functions 8 and the rules 9, and sends an environmental information signal, or a defrosting control signal, a to the defrosting control portion 4 only if it infers that the present time is an optimal time for starting a defrosting operation. The fuzzy reasoning portion 7 operates at a predetermined time interval and for each of the controllers 2A, 2B, 2C, . . . .

The membership functions 8 are used in order to judge the time allowance or degree of urgency before the next defrosting should be done, or how much frost has attached to the evaporator or how much time can elapse before the next defrosting, based on various data input to the fuzzy reasoning portion 7, such as the deviation ΔT, its a temporal variation dT, the time difference Δt, i.e., the time difference between the post-defrosting time $t_p$ and the standard defrosting time interval $t_0$, etc.

In this example, rules 9 are similar to those used in Example 1 but includes criteria on the post-defrosting time $t_p$, too.

As described above, the defrosting control unit for showcases according to the instant example infers the amount of frost which has settled on the evaporator and the time allowance for the next defrosting to be performed by fuzzy reasoning using knowledge obtained by technical experts in the field of defrosting of showcases. The fuzzy reasoning is based on various data such as the deviation ΔT, its temporal variation dT, and the time difference Δt, i.e., the time difference between the post-defrosting time tp and the standard defrosting time interval $t_0$, and realizes optimal control of defrosting devices.

Example 4

Figure 6:
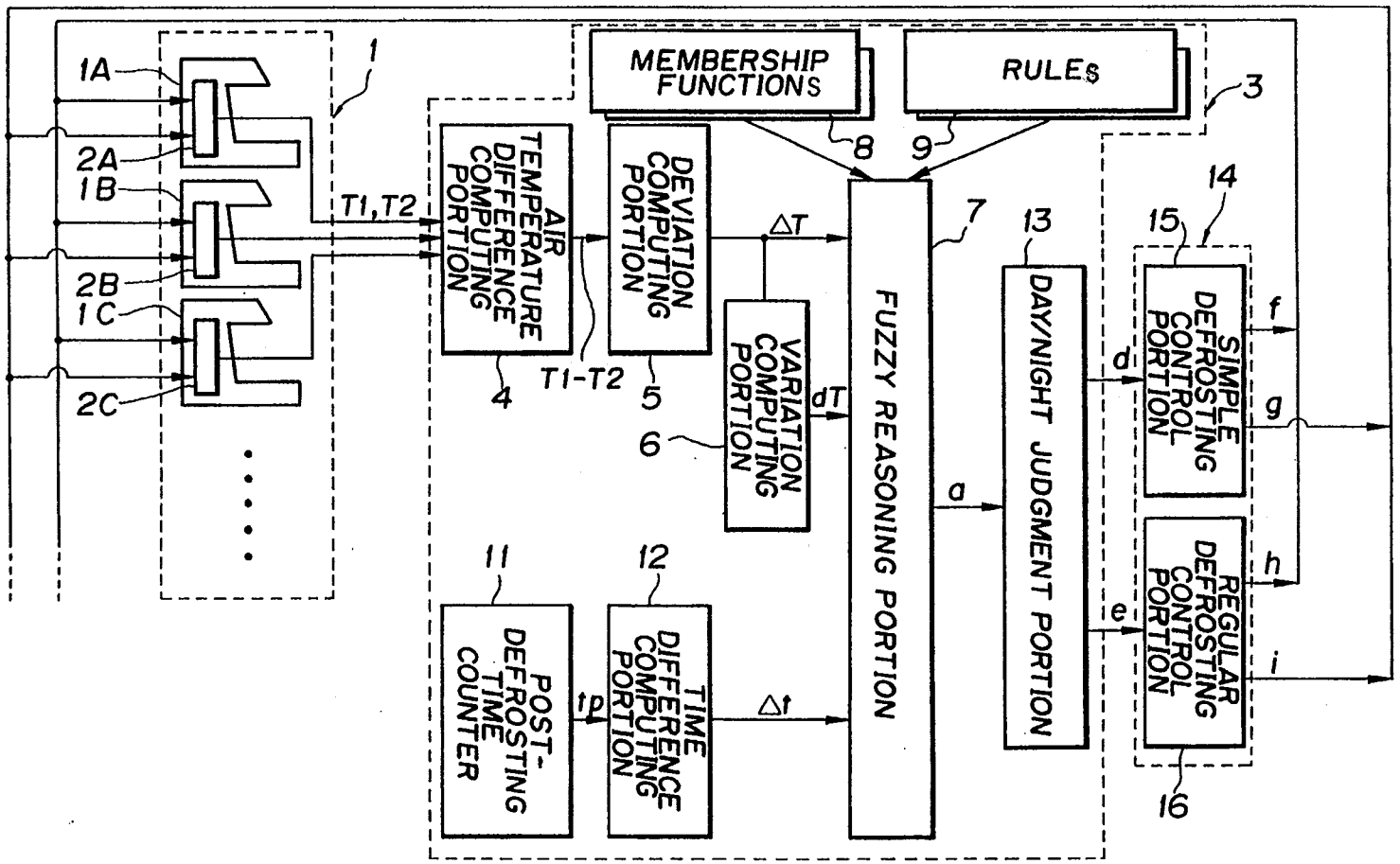
FIG. 6 is a block diagram showing the arrangement of a defrosting control unit according to a fourth example of the present invention.

FIG. 6 is a block diagram showing a defrosting control unit for showcases according to a fourth example of the present invention.

The defrosting control unit according to this example has the same arrangement as the second example shown in FIGS. 3 and 5 except that the situation-reflecting (environmental information) signal generation portion 3 includes a day/night judgment portion 13, and the defrosting control portion 14 comprises different types of defrosting control units . Reference numerals 1A, 1B, 1C, . . . , 2A, 2B, 2C, . . . , and 3 to 8 are the same as those shown in FIG. 2. Reference numeral 15 denotes a first or simple defrosting control portion, and 16 denotes a second or regular defrosting control portion.

In this example, the rules 9 comprise two types of rules, one for daytime, and the other for nighttime similar to but not identical to those presented in Tables 1 and 2, respectively. That is, the rules in this example contain criteria on a reduced amount of information or a smaller number of parameters concerning on the environment.

In the same manner as in Example 1, the variation computing portion 6 calculates the temporal variation dT of the deviation ΔT, and sends the result, dT, to the fuzzy reasoning portion 7. The post-defrosting time counter 11 counts a time $t_p$ which has passed from the completion of the immediately preceding defrosting operation.

The fuzzy reasoning portion 7 infers whether it is an optimal time to start a defrosting operation, considering the data input therein, by fuzzy reasoning based on the membership functions 8 and the rules 9, and sends an environmental information signal a to the day/night judgment portion 13 only if an inference is made that the present time is an optimal time to stare a defrosting operation. The inference action of the fuzzy reasoning portion 7 occurs at a predetermined time interval and for each of the controllers 2A, 2B, 2C, . . .

The membership functions 8 are used to judge the time allowance or degree of urgency before the next defrosting should be done, or how much frost has attached to the evaporator or how much time can elapse before the next defrosting, based on various data input to the fuzzy reasoning portion 7, including the the deviation ΔT, its temporal variation dT, and the time difference between the post-defrosting time tp and the standard defrosting time interval $t_0$. In this example, two groups of membership functions are used, one for daytime and the other for nighttime.

The rules 9 are applied when the fuzzy reasoning portion 7 infers the necessity of defrosting based on the conditions or data input to the fuzzy reasoning portion 7. Two stored sets of rules are stored, one for daytime and the other for nighttime. These rules are prepared based on know-how on defrosting control which a skilled artisan in the field of defrosting of showcases has.

Upon input of an environmental information signal a, the day/night judgment portion 13 judges whether it is daytime or nighttime when the signal is issued. The day/night judgment portion 13 and the simple defrosting control portion 15 and the regular defrosting control portion 16 act in the same manner as in Example 2, and sends a simple defrosting control signal d to the simple defrosting control portion 15 when it is daytime, and when it is nighttime, they send a regular defrosting control signal e to the regular defrosting control portion 16.

As described above, the defrosting control unit for showcases according to the instant example infers the amount of frost which has settled on the evaporator and the time allowance for the next defrosting to be performed by fuzzy reasoning using knowledge obtained by technical experts in the field of defrosting of showcases. The fuzzy reasoning is based on various data such as the deviation $\Delta T$, its temporal variation dT, and the time difference $\Delta t$, i.e., the time difference between the post-defrosting time $t_p$ and the standard defrosting time interval $t_0$, and realizes optimal control of defrosting devices.

Example 5

Figure 7:
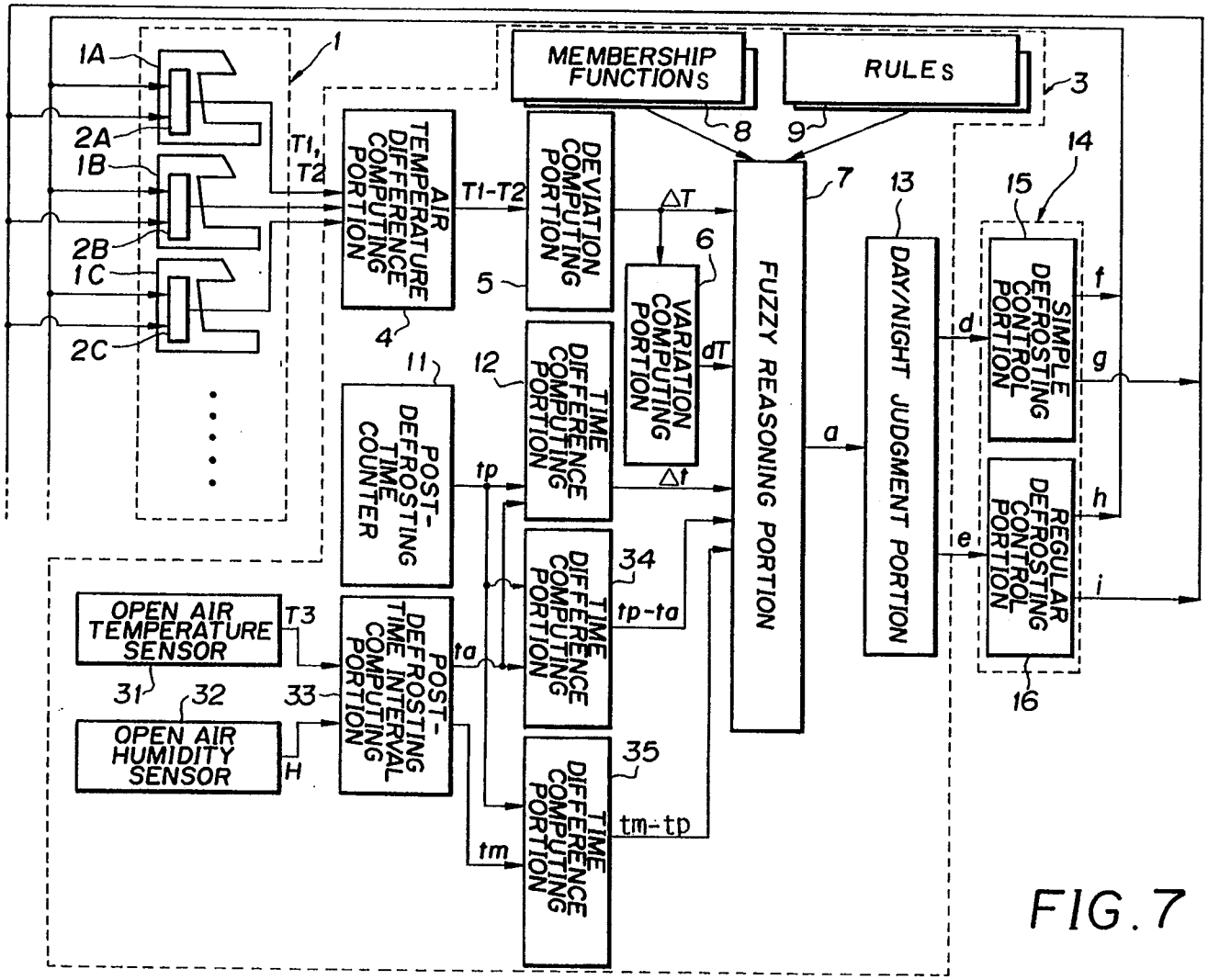
FIG. 7 is a block diagram showing the arrangement of a defrosting control unit according to a sixth example of the present invention.

FIG. 7 is a block diagram showing an arrangement of a defrosting control unit according to a fifth embodiment of the present invention.

The defrosting control unit of this example further includes an open air temperature sensor 31, an open air humidity sensor 32, a defrosting time interval computing portion 33, and time difference computing portions 34 and 35, in addition to the arrangement according to the fourth example of the invention shown in FIG. 6.

In the same manner as in Example 4, the variation computing portion 6 calculates the temporal variation dT of the deviation $\Delta T$ and sends the result to the fuzzy reasoning portion 7.

The post-defrosting time counter 11 determines the time $t_p$ that has elapsed from the preceding defrosting operation and sends the result to the time difference computing portions 12, 34 and 35, respectively.

The time difference corrupting portion 12 calculates the time difference $\Delta t$ between the time lapse $t_p$ and the standard defrosting time interval $t_0$, and sends the result to the fuzzy reasoning portion 7. In this example, different defrosting methods are used for daytime and nighttime, respectively. In this case, it is necessary to use four standards $t_{01}$, $t_{02}$, $t_{03}$ and $t_{04}$ as a standard defrosting time interval $t_0$ for four situations corresponding to the combinations of two defrosting methods with two states, i.e., before and after defrosting. The standard defrosting time interval $t_0$ is obtained as a moving average of previously used defrosting time intervals. For the initial run, an optimal defrosting time interval $t_a$ sent from the defrosting time interval computing portion 33 is used as a standard defrosting time interval $t_0$.

The open air temperature sensor 31 and open air humidity sensor 32 are arranged around the showcase 1, and detect temperature T3 and humidity H, respectively, and send the results to the defrosting time interval computing portion 33.

The defrosting time interval computing portion 33 calculates the enthalpy of open air from the temperature T3 of and humidity H of the open air. The defrosting time interval computing portion 33 obtains an optimal defrosting time interval $t_a$ from these values and sends the result to the time difference computing portions 12 and 34. Similarly, the defrosting time interval computing portion 33 calculates a marginal defrosting time interval $t_m$ from the enthalpy of the open air, and sends the result to the time difference computing portion 35.

The time difference computing portion 34 calculates the difference, $t_p - t_a$, i.e., the difference between the time lapse $t_p$ and the optimal defrosting time interval $t_a$, and sends the result to the fuzzy reasoning portion 7.

On the other hand, the time difference computing portion 35 calculates the difference, $t_m - t_p$, i.e., the difference between the time lapse $t_p$ and the marginal defrosting time interval $t_m$, and sends the result to the fuzzy reasoning portion 7.

The fuzzy reasoning portion 7 judges the data input therein by fuzzy reasoning based on the membership functions 8 and the rules 9, and sends an environmental information signal a to the day/night judgment portion 13 when the present time is a optimal time to start a defrosting operation. The operation of the fuzzy reasoning portion 7 is performed at a predetermined time interval for each of the controllers 2A, 2B, 2C, . . . .

The membership functions 8 are used to judge the time allowance or degree of urgency before the next defrosting should be done, or how much frost has attached the the evaporator or how much time can elapse before next frosting, based on various data input to the fuzzy reasoning portion 7, such as the deviation $\Delta T$, its temporal variation dT, time time difference $\Delta t$, etc. In this example, two different sets of membership functions are used, one for daytime and the other for nighttime.

Rules 9 are applied when the fuzzy reasoning portion 7 judges that defrosting is necessary based on the conditions or data input to the fuzzy reasoning portion 7.

The rules 9 are prepared based on know-how on defrosting control which a skilled artisan in the field of defrosting of showcases has.

Upon input of an environmental information signal a, the day/night judgment portion 13 judges whether the present time is daytime or nighttime, and sends a simple defrosting control signal d to the simple defrosting control portion 14 if it is daytime, and if it is nighttime, day/night judgement portion 13 sends a regular defrosting control signal e to a regular defrosting control portion 15.

When a simple defrosting control signal d is input, the simple defrosting control portion 14 sends a defrosting start signal f to each of the controllers 2A, 2B, 2C, . . . to start a defrosting operation in each of the showcases 1A, 1B, 1C, . . . , and then it sends a defrosting compulsive end signal g to each of the controllers 2A, 2B, 2C, . . . , after a short time within a time interval during which the temperature of each showcase does not increase substantially despite the defrosting operation.

Upon receipt of a regular defrosting control signal e, the regular defrosting control portion 15 sends a defrosting start signal h to each of the controllers 2A, 2B, 2C, . . . to start a defrosting operation. After a predetermined time has elapsed from initiation of the defrosting operation, the regular defrosting control device 15 sends a defrosting compulsive end signal i to each of the controllers 2A, 2B, 2C, . . . to compulsively end the defrosting operation for safety. The time interval between the issuance of the regular defrosting start signal h and the issuance of the defrosting compulsive end signal i is set up to be long enough for ordinary regular defrosting to be concluded.

The controllers 2A, 2B, 2C, . . . , upon receipt of defrosting start signals f or h, respectively, drive defrosting devices (not shown) such as electric heaters simultaneously. Thereafter, upon input of a defrosting compulsive end signal g, the controllers 2A, 2B, 2C, . . . stop the defrosting operation even though the defrosting has not been completed and switch over to the ordinary cooling operation. This type of defrosting is simple defrosting which is performed in the daytime.

When no defrosting compulsive end signal i is input to the controllers 2A, 2B, 2C, . . . , predetermined defrosting operation will be continued until respective defrosting termination functions provided with the controllers 2A, 2B, 2C, . . . start to operate. If the defrosting termination functions do not start to operate after a predetermined time from the initiation of the defrosting, the defrosting operation is terminated compulsively by a defrosting compulsive end signal i sent to the controllers 2A, 2B, 2C, . . . at that point in time. This type of defrosting operation is a regular defrosting operation which is performed in the nighttime.

Figure 8:
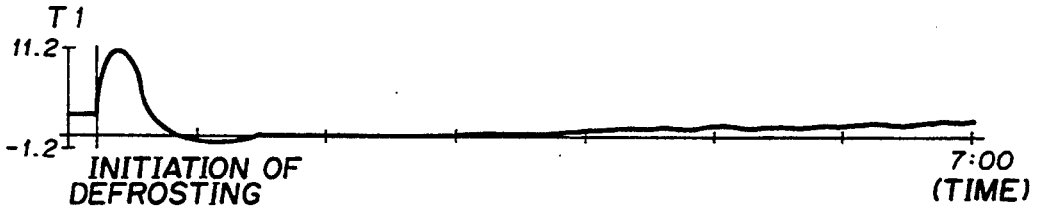
FIG. 8 is a graph illustrating an example of the change in temperature on the blow-out side of an inner duct.

FIG. 8 is a graph illustrating an example of changes in the temperature T1 of cool air detected by the temperature sensor 27 near the opening 22 of the inner duct 21 on its blow-out side. As illustrated in FIG. 8, the temperature T1 reaches the ordinary cooling state, after about 2 hours from the initiation of the defrosting, and this stable state continues for about 1 hour. Thereafter, the temperature T1 gradually increases as a result of frosting.

Figure 9:
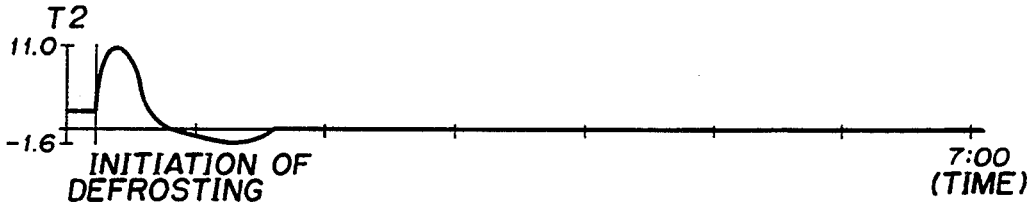
FIG. 9 is a graph illustrating an example of the change in temperature at the outlet of an evaporator.

FIG. 9 is a graph illustrating an example of changes in the temperature T2 of cool air detected by the temperature sensor 26 near the outlet 25*a* of the evaporator 25 in the inner duct 21. As illustrated in FIG. 9, the temperature T2 reaches a stable ordinary cooling state after 2 hours from the initiation of the defrosting, similar to the case illustrated in FIG. 8.

Figure 10:
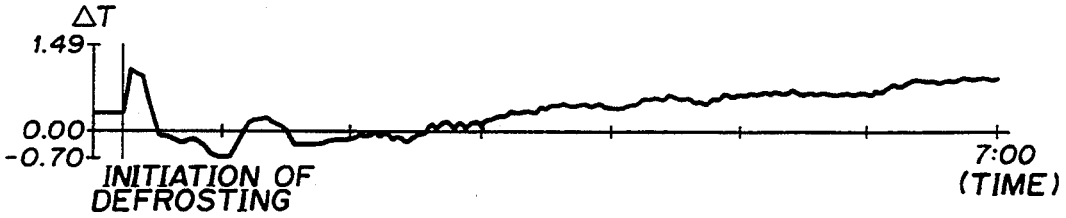
FIG. 10 is a graph illustrating the change in the deviation of the air temperature difference with respect to a stable-state value of the air temperature difference.

FIG. 10 is a graph illustrating the temporal variation of the deviation $\Delta T$ with respect to a stable-state value $T_0$ of the temperature difference T1–T2, i.e., the temperature difference calculated from temperatures T1 and T2 illustrated in FIGS. 8 and 9, respectively. The stable-state value $T_0$ is an average of the temperature differences T1–T2 obtained by measurements in the same stabilized period for every regular defrosting operation.

In this example, technical know-how which technical experts in the field of defrosting of showcases have learned from experience are is systematized into a set of rules as follows: (1) If the deviation $\Delta T$ of the air temperature difference between the inner blow-out air temperature T1 and the evaporation outlet air temperature T2 becomes high, then defrosting is carried out. (2) With a small deviation $\Delta T$ similarly to (1) above, if the time difference $\Delta t$ between the post-defrosting time $t_p$ and the standard defrosting time interval $t_0$ is large, then defrosting is carried out. (3) If the variation dT of the deviation $\Delta T$ is large, then defrosting is carried out. (4) If the time difference $\Delta t$ between the post-defrosting time $t_p$ and the standard defrosting time interval $t_0$ becomes large, then defrosting is carried out. (5) If the time difference $t_m - t_p$ between the post-defrosting time $t_p$ and the marginal defrosting time interval $t_m$ is small, then defrosting is always carried out.

Tables 1 and 2 show these rules as daytime and nighttime fuzzy rules, respectively. In Tables 1 and 2, the term "standard time" means a time at which control modes switch over from a control mode for daytime to a control mode for nighttime and vice versa. In the instant example, a defrosting operation is carried out compulsively when a standard time is reached, and hence a rule has been added that a defrosting operation is put off when it is drawing near to a standard time. The term "longest cycle" means a marginal defrosting time interval $t_m$ output from the defrosting time interval computing portion 33. Further, the term "enthalpy defrosting time interval" means an optimal defrosting time interval $t_a$ output from the defrosting time interval computing portion 33.

TABLE 1

Rule For Daytime

| | IF (Prior Term) | | | | | | THEN (Posterior Term) |
|---|---|---|---|---|---|---|---|
| No. | A | B | C | D | E | F | G |
| 1 | Negative | Negative large | | | | | Defrosting |
| 2 | Negative | Negative | | | | | Defrosting |
| 3 | Negative | Zero | | | | | Defrosting |
| 4 | Negative | Positive | | | | | Absolutely defrosting |
| 5 | Negative | Positive large | | | | | Absolutely defrosting |
| 6 | Zero | Negative large | | | | | Absolutely no defrosting |
| 7 | Zero | Negative | | | | | No defrosting |
| 8 | Zero | Zero | | | | | No defrosting |
| 9 | Zero | Positive | | | | | No defrosting |
| 10 | Zero | Positive large | | | | | Defrosting |
| 11 | Positive small | Negative large | | | | | No defrosting |
| 12 | Positive small | Negative | | | | | Defrosting |
| 13 | Positive small | Zero | | | | | Defrosting |
| 14 | Positive small | Positive | | | | | Defrosting |
| 15 | Positive small | Positive large | | | | | Absolutely defrosting |
| 16 | Positive | Negative large | | | | | Absolutely defrosting |
| 17 | Positive | Negative | | | | | Absolutely defrosting |
| 18 | Positive | Zero | | | | | Absolutely defrosting |
| 19 | Positive | Positive | | | | | Absolutely defrosting |
| 20 | Positive | Positive large | | | | | Absolutely defrosting |
| 21 | Positive large | | | | | | Regular defrosting |
| 22 | | | | Great decrease | | | Absolutely defrosting |

TABLE 1-continued

| Rule For Daytime | | | | | | | |
|---|---|---|---|---|---|---|---|
| | IF (Prior Term) | | | | | | THEN (Posterior Term) |
| No. | A | B | C | D | E | F | G |
| 23 | | | | Great increase | | | Absolutely defrosting |
| 24 | | | | | | Negative | No defrosting |
| 25 | | | | | | Positive small | Defrosting |
| 26 | | | | | | Positive | Absolutely defrosting |

TABLE 1-continued

| Rule For Daytime | | | | | | | |
|---|---|---|---|---|---|---|---|
| | IF (Prior Term) | | | | | | THEN (Posterior Term) |
| No. | A | B | C | D | E | F | G |

Notes:
PRIOR TERM:
A: deviation of the air temperature difference between the inner duct blow-out air temperature and the evaporator outlet air temperature;
B: difference between the post-defrosting time interval and the standard defrosting time interval;
C: time till a standard time;
D: variation of the deviation of the difference between the inner duct blow-out air temperature and the evaporator outlet air temperature;
E: difference between the longest cycle and time after regular defrosting;
F: difference between the post-defrosting time interval and the enthalpy defrosting time interval;
POSTERIOR TERM:
G: presence or absence of defrosting.

TABLE 2

| Rule For Nighttime | | | | | | | |
|---|---|---|---|---|---|---|---|
| | IF (Prior Term) | | | | | | THEN (Posterior Term) |
| No. | A | B | C | D | E | F | G |
| 1 | Negative | Negative large | | | | | Defrosting |
| 2 | Negative | Negative | | | | | Defrosting |
| 3 | Negative | Zero | | | | | Defrosting |
| 4 | Negative | Positive | | | | | Absolutely defrosting |
| 5 | Negative | Positive large | | | | | Absolutely defrosting |
| 6 | Zero | Negative large | | | | | Absolutely no defrosting |
| 7 | Zero | Negative | | | | | No defrosting |
| 8 | Zero | Zero | | | | | No defrosting |
| 9 | Zero | Positive | | | | | No defrosting |
| 10 | Zero | Positive large | | | | | Wait-and-see |
| 11 | Positive small | Negative large | | | | | No defrosting |
| 12 | Positive small | Negative | | | | | No defrosting |
| 13 | Positive small | Zero | | | | | No defrosting |
| 14 | Positive small | Positive | | | | | Wait-and-see |
| 15 | Positive small | Positive large | | | | | Defrosting |
| 16 | Positive | Negative large | | | | | Wait-and-see |
| 17 | Positive | Negative | | | | | Wait-and-see |
| 18 | Positive | Zero | | | | | Defrosting |
| 19 | Positive | Positive | | | | | Defrosting |
| 20 | Positive | Positive large | | | | | Absolutely defrosting |
| 21 | Positive large | Negative large | | | | | Defrosting |
| 22 | Positive large | Negative | | | | | Absolutely defrosting |
| 23 | Positive large | Zero | | | | | Absolutely defrosting |
| 24 | Positive large | Positive | | | | | Absolutely defrosting |
| 25 | Positive large | Positive large | | | | | Absolutely defrosting |
| 26 | | | | Great decrease | | | Absolutely defrosting |
| 27 | | | | Great increase | | | Absolutely defrosting |
| 28 | Negative | | Before forbidden | | | | Absolutely defrosting |

TABLE 2-continued

| | Rule For Nighttime | | | | | | |
|---|---|---|---|---|---|---|---|
| | IF (Prior Term) | | | | | | THEN (Posterior Term) |
| No. | A | B | C | D | E | F | G |
| | | | region | | | | |
| 29 | Positive small | | Before forbidden region | | | | Defrosting |
| 30 | Positive | | Before forbidden region | | | | Absolutely defrosting |
| 31 | Positive large | | Before forbidden region | | | | Absolutely defrosting |
| 32 | | | | | Small | | Absolutely defrosting |
| 33 | | | | | | Negative | No defrosting |
| 34 | | | | | | Zero | Wait-and-see |
| 35 | | | | | | Positive | Defrosting |

NOTES:
PRIOR TERM:
A: deviation of the air temperature difference between the inner duct blow-out air temperature and the evaporator outlet air temperature;
B: difference between the post-defrosting time interval and the standard defrosting time interval;
C: time still a standard time;
D: variation of the deviation of the difference between the inner duct blow-out air temperature and the evaporator outlet air temperature;
E: difference between the longest cycle and the time after regular defrosting;
F: difference between the post-defrosting time interval and the enthalpy defrosting time interval;
POSTERIOR TERM:
G: presence or absence of defrosting.

Figure 13:
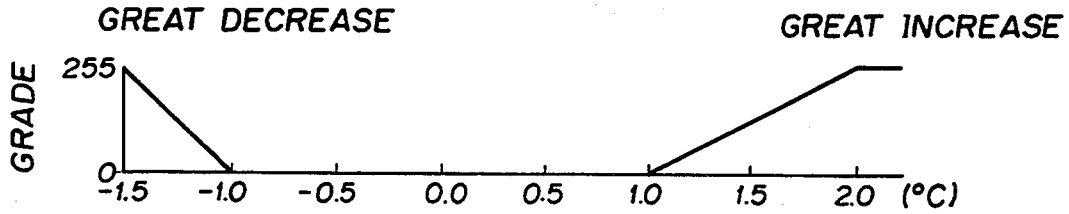
FIG. 13 is a diagram illustrating prior term membership function for daytime, and represents the variation of the deviation of the difference between the inner duct blow-out air temperature and the evaporator outlet air temperature (daytime)
Figure 14:
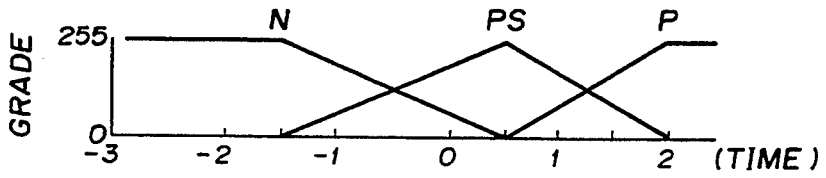
FIG. 14 is a diagram illustrating prior term membership function for daytime, and represents the difference between the post-defrosting time and the enthalpy defrosting time interval (daytime)
Figure 15:
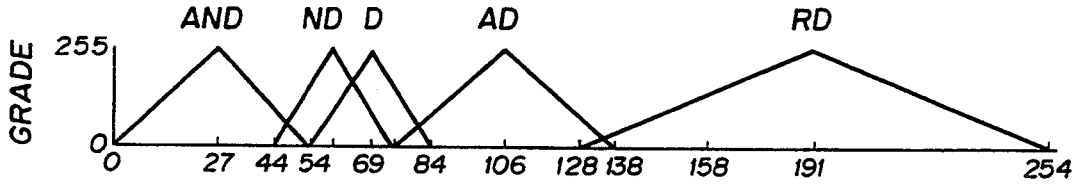
FIG. 15 is a diagram illustrating a posterior term membership function for daytime, and represents the presence or absence or defrosting (daytime)

FIGS. 11, 12, 13, 14 and 15 are diagrams illustrating membership functions, respectively, set up in accordance with Table 1 for daytime. In FIGS. 11 to 14, NL stands for negative large, NS stands for negative small, N stands for negative, Z stands for zero, P stands for positive, PS stands for positive small, and PL stands for positive large. In FIG. 15, AND stands for absolutely no defrosting, ND stands for no defrosting, D stands for defrosting, AD stands for absolutely defrosting, and RD stands for regular defrosting.

Figure 11:
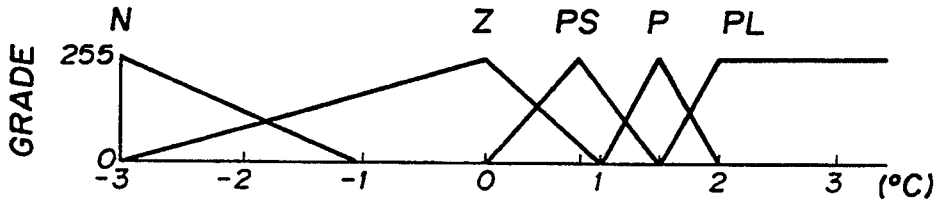
FIG. 11 is a diagram illustrating prior term membership functions for daytime, and represents the deviation of the difference between the inner duct blow-out air temperature and the evaporator outlet air temperature (daytime)

More specifically, FIG. 11 is a diagram illustrating membership functions for the deviation $\Delta T$ of the stable-state value of the difference between the inner duct blow-out air temperature and the evaporator outlet air temperature.

Figure 12:
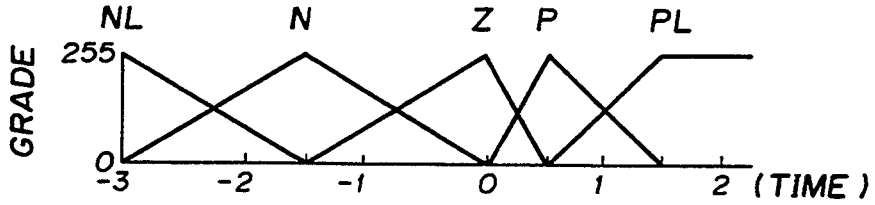
FIG. 12 is a diagram illustrating prior term membership function for daytime, and represents the difference between the post-defrosting time and the standard defrosting time interval (daytime)

FIG. 12 is a diagram illustrating membership functions for the time difference $\Delta t$, i.e., the difference between the post-defrosting time and a standard defrosting time interval.

FIG. 13 is a diagram illustrating a membership functions for the temporal variation dT, i.e., the temporal variation of the deviation $\Delta T$ with respect to the stable-state value of the difference between the inner duct blow-out air temperature and the evaporator outlet air temperature.

FIG. 14 is a diagram illustrating membership functions for the time difference $(t_p - t_a)$ between the post-defrosting time $t_p$ and the enthalpy defrosting time interval $t_a$.

FIG. 15 is a diagram illustrating which specifies the membership functions for a posterior term portion on presence or absence of a defrosting operation.

Figure 16:
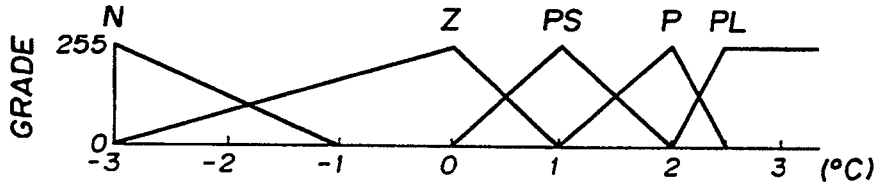
FIG. 16 is a diagram illustrating prior term membership functions for nighttime, and represents the deviation of the difference between the inner duct blow-out air temperature and the evaporator outlet air temperature (nighttime)
Figure 17:
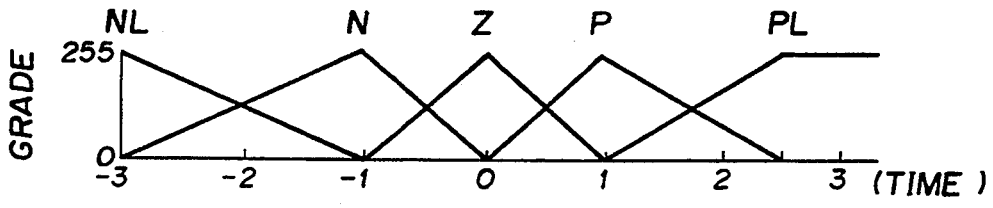
FIG. 17 is a diagram illustrating prior term membership functions for nighttime, and represents the difference between the post-defrosting time and the standard defrosting time interval (nighttime)
Figure 19:
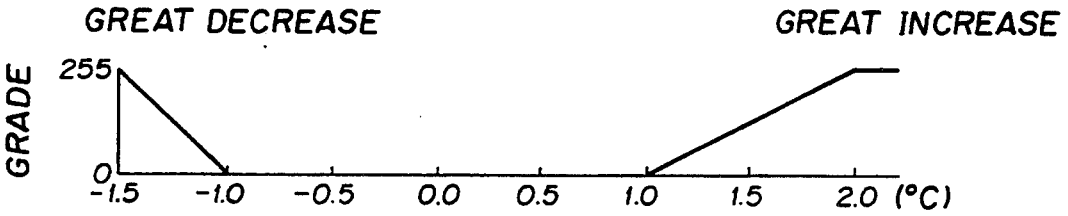
FIG. 19 is a diagram illustrating prior term membership functions for nighttime, and represents the variation of the deviation of the difference between the inner duct blowout air temperature and the evaporator outlet air temperature (nighttime)
Figure 20:
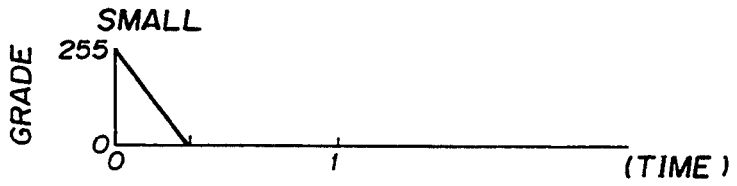
FIG. 20 is a diagram illustrating prior term membership functions for nighttime, and represents the difference between the longest cycle and the time that has passed after regular defrosting.
Figure 21:
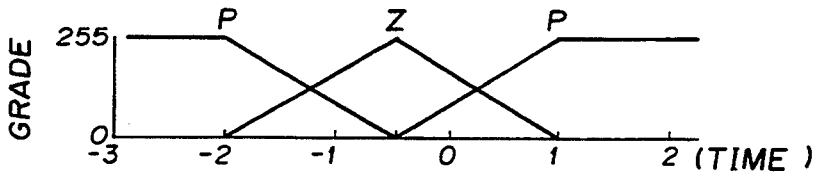
FIG. 21 is a diagram Illustrating a prior term membership functions for nighttime, and represents the difference between the post-defrosting time and the enthalpy defrosting time interval (nighttime)
Figure 22:
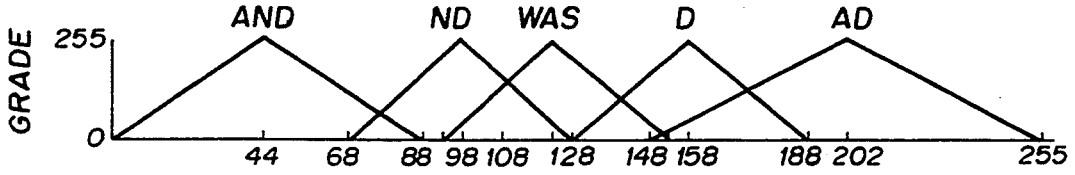
FIG. 22 is a diagram illustrating a posterior term membership functions for nighttime, and represents the presence or absence of defrosting (nighttime)

On the other hand, FIGS. 16, 17, 18, 19, 20, 21 and 22 are diagrams illustrating membership functions, respectively, set up in accordance with Table 2 for nighttime. In FIGS. 16, 17 and 21, NL stands for negative large, NS stands for negative small, N stands for negative, Z stands for zero, P stands for positive, PS stands for positive small, and PL stands for positive large. In FIG. 22, AND stands for absolutely no defrosting, ND stands for no defrosting, D stands for defrosting, AD stands for absolutely defrosting, and WAS stands for wait-and-see.

More specifically, FIG. 16 is a diagram illustrating membership functions for the deviation $\Delta T$ of the stable-state value of the difference between the inner duct blow-out air temperature and the evaporator outlet air temperature.

FIG. 17 is a clip, gram illustrating membership functions for the time difference $\Delta t$, i.e., the difference between the post-defrosting time and a standard defrosting time interval.

Figure 18:
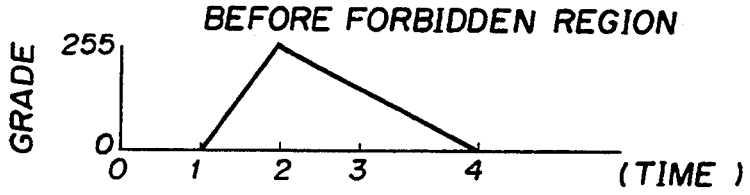
FIG. 18 is a diagram illustrating prior term membership functions for nighttime and represents the time till the standard time (nighttime)

FIG. 18 is a diagram illustrating membership functions for the time till a standard time.

FIG. 19 is a diagram illustrating membership functions for the temporal variation dT, i.e., the temporal variation of the deviation $\Delta T$ with respect to the stable-state value of the difference between the inner duct blow-out air temperature and the evaporator outlet air temperature.

FIG. 20 is a diagram illustrating membership functions for the time difference $(t_p - t_m)$ between the post-defrosting time $t_p$ and the longest cycle $t_m$.

FIG. 21 is a diagram illustrating membership functions for the time difference $(t_p - t_a)$ between the post-defrosting time $t_p$ and the enthalpy defrosting time interval $t_a$.

FIG. 22 is a diagram illustrating membership functions for the posterior term portion which specifies the presence or absence of a defrosting operation.

As described above, the defrosting control unit for showcases according to the instant example infers the amount of frost attached to the evaporator and the time allowance for the next defrosting to be performed from the conditions of the open air by fuzzy reasoning using knowledge obtained by technical experts in the field of defrosting of showcases. Various data are used such as the deviation $\Delta T$, its temporal variation dT, the time difference $\Delta t$ between a post-defrosting time $t_p$ and the standard defrosting time interval $t_0$, and so on, and optimal control of defrosting devices is achieved separately depending on whether it is daytime or nighttime.

Example 6

Figure 23:
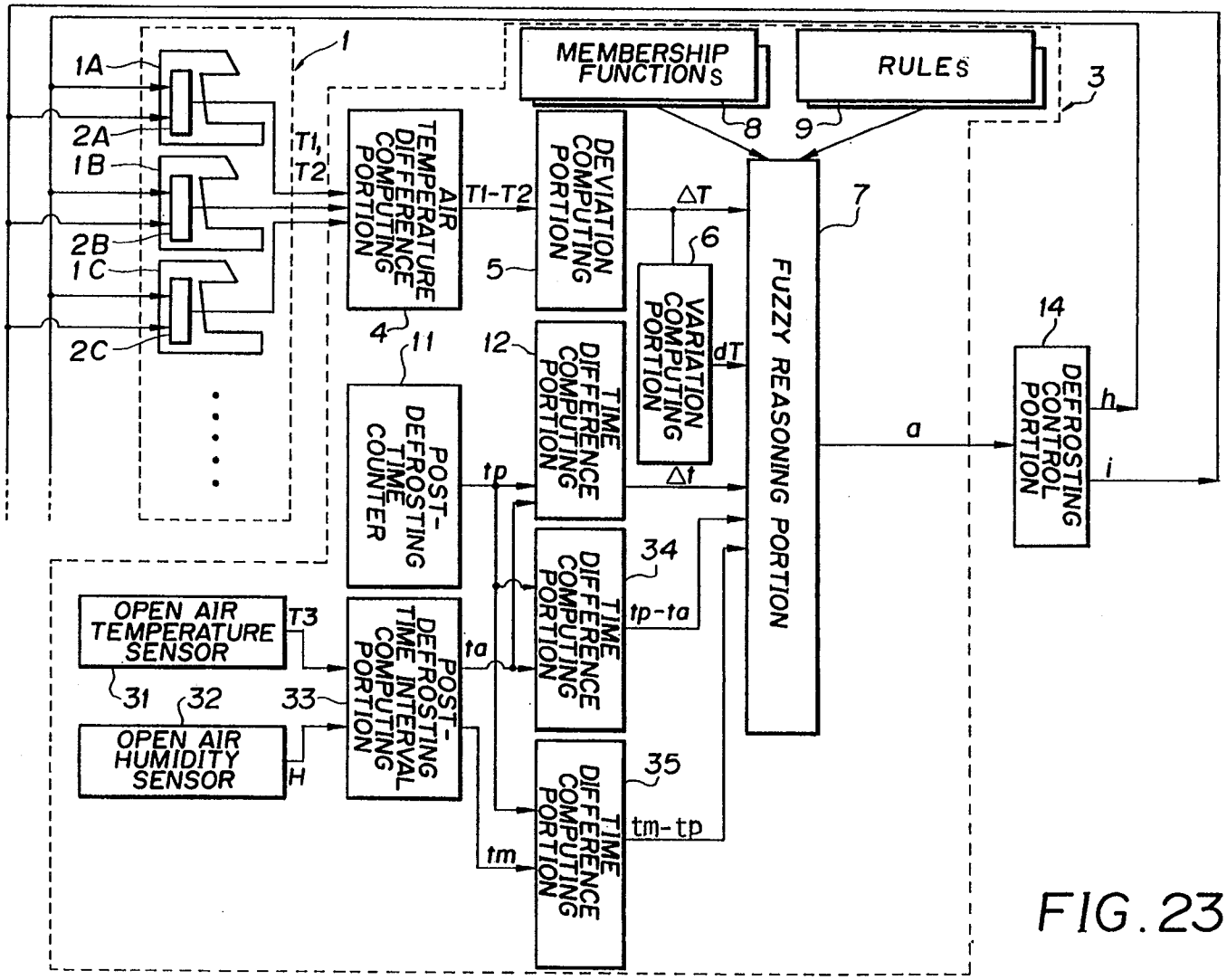
FIG. 23 is a block diagram showing the arrangement of a defrosting control unit according to a seventh example of the present invention.

FIG. 23 is a block clip, gram showing an arrangement of a defrosting control unit according to a sixth example of the present invention.

The defrosting control unit according to this example has the same arrangement as the fifth example shown in FIG. 7 except that the day/night judgment portion 13 in the situation-reflecting (environmental information) signal generation portion 3 is absent, and a sole defrosting control portion in Example 4 is used instead of two different defrosting control portions 15 and 16.

The membership functions 8 and the rule 9 are the same as those for nighttime in Example 5 shown in FIG. 7.

The defrosting control portion 14, upon input of an environmental information signal, or a defrosting control signal, a from the fuzzy reasoning portion 7, sends a defrosting start signal h to each of the showcase controllers 2A, 2B, 2C, . . . , and after a predetermined time from the initiation of a defrosting operation in each showcase, the defrosting control portion 4 sends a defrosting compulsive end signal i to each of the showcase controllers 2A, 2B, 2C, . . . to terminate the defrosting operation compulsively.

The showcase controllers 2A, 2B, 2C, . . . drive defrosting devices (not shown) such as electric heaters simultaneously to start defrosting. Thereafter, defrosting is continued until termination function provided in each controller operates. If the termination function does not operate even after a predetermined time, the defrosting operation is compulsively terminated by the defrosting compulsively end signal i sent at that point in time. This defrosting operation is the same as the regular defrosting for nighttime used in Example 5.

In this example, an optimal timing for starting a defrosting operation can be determined precisely by fuzzy reasoning based on the know-how of technical experts in the field of defrosting of showcases, more particularly by making an inference on the amount of frost and a decision about the timing for starting a defrosting operation taking into consideration the state of the open air. Further, renewal of data used for control in accordance the with state of defrosting of showcases for each defrosting operation makes it possible to control defrosting with higher precision.

As a result, goods in showcases can be kept fresh without damaging customers' purchasing volition, and also electricity needed for defrosting devices can be saved.

Example 7

Figure 24:
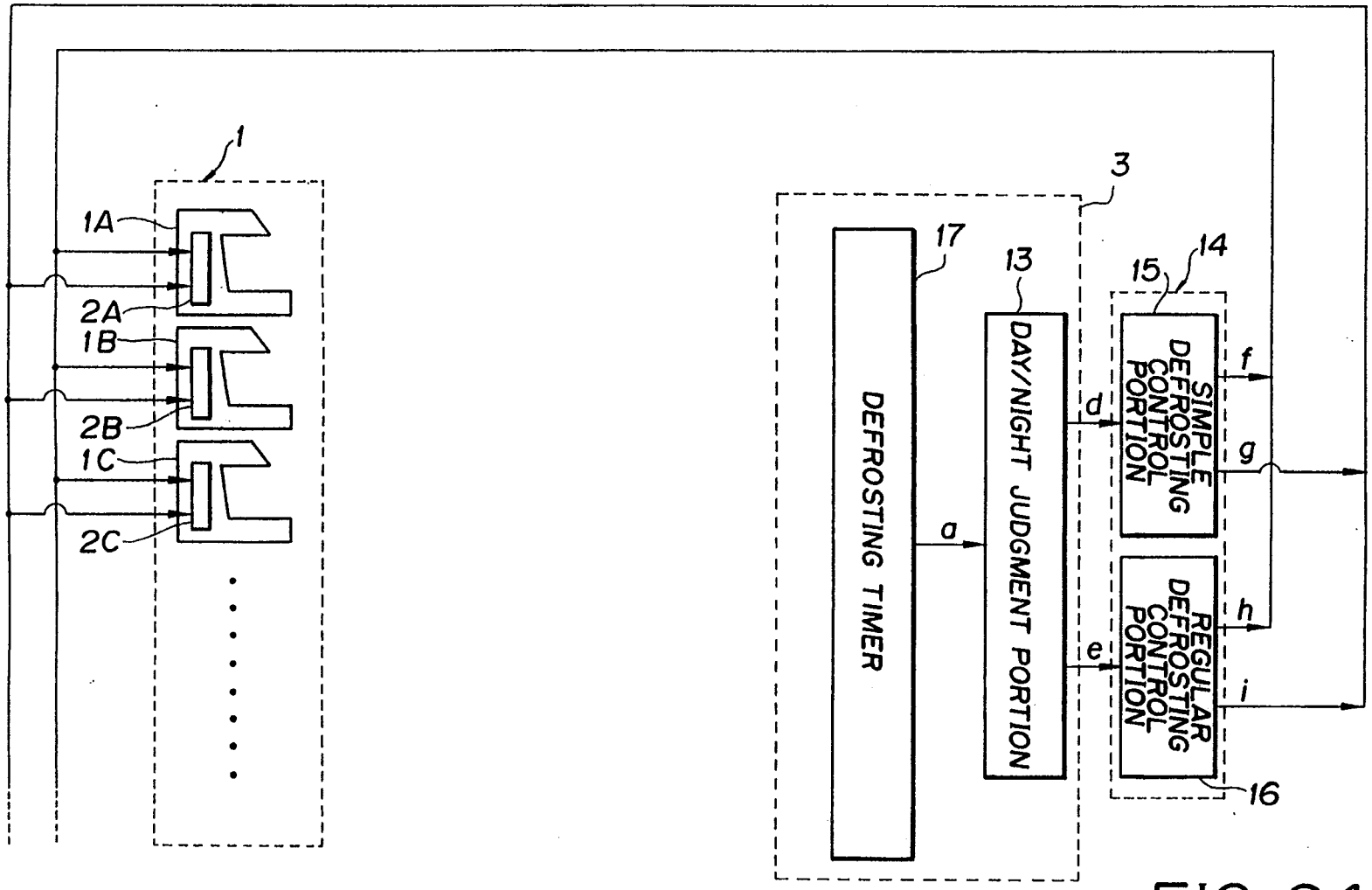
FIG. 24 is a block diagram showing the arrangement of a defrosting control unit according to an eighth example of the present invention.

FIG. 24 is a block diagram showing an arrangement of a defrosting control unit for showcases according to a seventh example of the present invention.

In FIG. 24, reference numeral 1 denotes showcase, 1A, 1B, 1C, . . . , and so on denote showcase units, 2A, 2B, 2C, . . . and so denote on showcase controllers, 3 denotes a situation-reflecting (environmental information) signal generation portion, 13 denotes a day/night judgment portion, 14 denotes a defrosting control portion, 15 denotes a first or simple defrosting control portion, 16 denotes a second or regular defrosting control portion, 17 denotes a defrosting timer, a denotes an environmental information signal, d and e denote defrosting control signals, f and h denote defrosting start signals, and g and i defrosting compulsive end signals.

The defrosting control unit according to this example has the same arrangement as the first example shown in FIGS. 2 and 3 except that the situation-reflecting (environmental information) signal generation portion 3 includes a defrosting timer and a day/night judgment portion only, and the defrosting control portion 14 comprises a first or simple defrosting control unit 15 and a second or regular defrosting control portion 16.

In this example, the defrosting timer 17 corresponds in function to the fuzzy reasoning portion 7 shown in FIG. 4, and sends an environmental information signal a to the day/night judgment portion 13 at a predetermined time. Upon receipt of the environmental information signal a, the day/night judgment portion 13 judges whether it is daytime or nighttime when the signal a is issued. The day/night judgment portion 13 and the simple defrosting control portion 15 and the regular defrosting control portion 16 act in the same manner as in Example 2. That is, the day/night judgment portion 13 sends a simple defrosting control signal d to the simple defrosting control portion 15 if it is a daytime, or a regular defrosting start signal e to the regular defrosting control portion 16 if it is a nighttime. The simple defrosting control portion 15 and the regular defrosting control portion 16 send signals f and g, and h and i, respectively, as in Example 2, and the defrosting operation is carried out in the same manner as in Example 2 above.

In this example, simple and regular defrosting operations can be carried out at predetermined times set up according to crowdedness of customers by a simple arrangement without resorting to fuzzy reasoning. That is, in the daytime when the shop is crowded with customers, a simple defrosting operation is carried out to establish a quasi-non-defrosting state, thereby preventing of goods from deteriorating in freshness and avoiding damaging the customers' volition to purchase goods.

The defrosting control unit for showcases according to this example is advantageous since the time for starting a defrosting operation can be set up freely so that a time zone which is unsuitable for starting a defrosting operation can be excluded.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A defrosting control unit for a showcase having a showcase unit with an inner duct for circulating air, an evaporator provided in the inner duct to cool the air circulating in the inner duct, and a defrosting device attached to the evaporator, the defrosting device having heating means for melting frost which has settled on the evaporator, the defrosting device additionally having a defrosting termination function, said defrosting control unit comprising:

a situation-reflecting signal generation portion which generates a situation-reflecting signal for starting a defrosting control operation, said situation-reflecting signal generation portion including a fuzzy reasoning portion, membership functions, and rules, said situation-reflecting signal reflecting a present situation expressed in terms of a result of fuzzy reasoning conducted by said fuzzy reasoning portion, said fuzzy reasoning portion inferring an optimal time for starting a defrosting operation based on at least one environmental parameter or value derived therefrom as an element of a fuzzy set, said environmental parameter or value derived therefrom being selected from the group consisting of (a) an optimal defrosting time interval obtained from the temperature and humidity of open air, (b) a marginal defrosting time interval obtained from the temperature and humidity of open air, (c) a stable-state value, the stable-state value being an average value of a difference between the temperature of air blown out of said inner duct and the temperature of air immediately after it passes said evaporator over a period after said difference has reached a steady state, (d) a deviation, from said stable-state value, of an actual value of the difference between the temperature of air blown out of said inner duct and the temperature of air immediately after it passes said evaporator, (e) a temporal variation of said deviation, (f) a difference between a post defrosting time and said optimum defrosting interval, and (g) a difference between said post defrosting time and said marginal defrosting time;

a defrosting control portion which receives said situation-reflecting signal from said situation-reflecting signal generation portion and generates, upon receipt of said situation-reflecting signal, a defrosting control start signal; and a showcase unit controller connected to said heating means, said showcase unit controller driving said heating means upon receipt of said defrosting control start signal to start a defrosting operation, wherein said defrosting control portion also generates a defrosting end signal for safety after a predetermined time from said starting of said defrosting operation if defrosting has not been stopped by said defrosting termination function of said defrosting device, and wherein said showcase unit controller terminates said defrosting operation of said heating means upon receipt of said defrosting end signal.

2. The defrosting control unit as claimed in claim 1, wherein said showcase unit further comprises:

a first temperature sensor for detecting a first air temperature of air blown out from said inner duct; and a second temperature sensor for detecting a second air temperature of air immediately after passing said evaporator, and wherein said situation-reflecting signal-generating portion further comprises:

an air temperature difference computing portion which receives data on said first temperature from said first temperature sensor and data on said second temperature from said second temperature sensor, and computes an air temperature difference between said first and second air temperatures;

a stable-state value renewal and store portion which calculates an average of said air temperature difference during a stable period between completion of defrosting and frosting after said completion of defrosting after each defrosting action, and renews and stores said average as said stable-state value;

a deviation computing portion which receives data on said air temperature difference from said air temperature difference computing portion and computes said deviation of said air temperature difference with respect to said stable-state value; and a variation computing portion which receives data on said deviation of said air temperature difference and calculates said temporal variation of said deviation, said temporal variation being sent to said fuzzy reasoning portion and used as an element of said fuzzy set for fuzzy reasoning.

3. The defrosting control unit as claimed in claim 2, wherein said situation-reflecting signal generation portion further comprises:

a post-defrosting time counter which counts the time that has passed from a previous defrosting operation; and a time difference computing portion which computes a time difference between said post-defrosting time and a past defrosting time interval which has been stored, said time difference being sent to said fuzzy reasoning portion and used as a element of said fuzzy set for fuzzy reasoning.

4. The defrosting control unit as claimed in claim 3, wherein said situation-reflecting signal generation portion further comprises:

a third temperature sensor for detecting said open air temperature;

a humidity sensor for detecting said open air humidity;

a defrosting time interval computing portion which calculates said optimal defrosting time interval from said open air temperature and said open air humidity and sends said optimal defrosting time interval to a second time difference computing portion that computes said difference between said post defrosting time and said optimal defrosting time interval, said defrosting time interval computing portion also calculating said marginal defrosting time interval from said open air temperature and said open air humidity and sending said marginal defrosting time interval to a third time difference computing portion that computes said difference between said post defrosting time and said marginal defrosting time interval; and means for deeming said optimal defrosting time interval as a past defrosting time interval result in the absence of the past defrosting time interval result.

5. The defrosting control unit for a showcase having a showcase unit with an inner duct for circulating air, an evaporator provided in the inner duct to cool the air circulating in the inner duct, and a defrosting device attached to the evaporator, the defrosting device having heating means for melting frost which has settled on the evaporator, the defrosting means additionally having a defrosting termination function, said defrosting control unit comprising:

a situation-reflecting generation portion which generates a situation-reflecting signal for starting a defrosting control operation, said situation-reflecting signal generation portion including a fuzzy reasoning portion, membership functions, and rules, said situation-reflecting signal reflecting a present situation expressed in terms of a result of fuzzy reasoning conducted by said fuzzy reasoning portion, said fuzzy reasoning portion inferring an optimal time for starting a defrosting operation based on at least one environmental parameter or value derived therefrom as an element of a fuzzy set, said environmental parameter or value derived therefrom being selected from the group consisting of (a) an optimal defrosting time interval obtained from the temperature and humidity of open air, (b) a marginal defrosting time interval obtained from the temperature and humidity of open air, (c) a stable-state value, the stable-state value being an average value of a difference between the temperature of air blown out of said inner duct and the temperature of air immediately after it passes said evaporator over a period after said difference has reached a steady state, (d) a deviation, from said stable-state value, of an actual value of the difference between the temperature of air blown out of said inner duct and the temperature of air immediately after it passes said evaporator, (e) a temporal variation of said deviation, (f) a difference between a post defrosting time and said optimum defrosting interval, and (g) a difference between said post defrosting time and said marginal defrosting time, said situation-reflecting signal generation portion additionally including a day/night judgment portion which receives said situation-reflecting signal from said fuzzy reasoning portion and judges whether a present time is daytime or nighttime based on a comparison with predetermined standard points in time for determining whether it is daytime or nighttime, said day/night judgment portion generating a simple defrosting control signal if said present time is daytime when said situation-reflecting signal is received and generating a regulator defrosting control signal if said present time is nighttime when said situation-reflecting signal is received;

a showcase unit controller connected to said heating means, said showcase unit controller driving said heating means upon receipt of a defrosting start signal to start a defrosting operation, said showcase unit controller also terminating said defrosting operation upon receipt of a defrosting compulsive end signal if said defrosting operation has not already been stopped by said defrosting termination function of said defrosting device; and a defrosting control portion which includes a simple defrosting control portion and a regular defrosting control portion, said simple defrosting control portion receiving said simple defrosting control signal and said regular defrosting control portion receiving said regular defrosting control signal, wherein said simple defrosting control portion sends said defrosting start signal to said showcase unit controller upon receipt of said simple defrosting control signal and then sends said defrosting compulsive end signal to said showcase unit controller at a first time interval during which substantially no increase in temperature occurs to terminate said defrosting operation compulsively, and wherein said regular defrosting control portion sends said defrosting start signal to said showcase unit controller upon receipt of said regular defrosting control signal and then sends said defrosting compulsive end signal to said showcase unit controller at a second time interval during which sufficient defrosting occurs and there is no excessive increase in temperature.

6. The defrosting control unit as claimed in claim 5, wherein said showcase unit further comprises:

a first temperature sensor for detecting a first air temperature of air blown out from said inner duct; and a second temperature sensor for detecting a second air temperature of air immediately after passing said evaporator, and wherein said situation-reflecting signal generation portion further comprises:

an air temperature difference computing portion which receives data on said first temperature from said first temperature sensor and data on said second temperature from said second temperature sensor and computes an air temperature difference between said first and second air temperatures;

a stable-state value renewal and store portion which calculates an average of said air temperature difference during a stable period between completion of defrosting and frosting after said completion of defrosting after each defrosting action, and renews and stores said average as said stable-state value;

a deviation computing portion which receives data on said air temperature difference from said air temperature difference computing portion and computes said deviation of said air temperature difference with respect to said stable-state value; and a variation computing portion which receives data on said deviation of said air temperature difference and calculates said temporal variation of said deviation, said temporal variation being sent to said fuzzy reasoning portion and used as an element of said fuzzy set for fuzzy reasoning.

7. The defrosting control unit as claimed in claim 6, wherein said situation-reflecting signal generation portion further comprises:

a post-defrosting time counter which counts the time that has passed from a previous defrosting operation; and a time difference computing portion which computes a time difference between said post-defrosting time and a past defrosting time interval which has been stored, said time difference being sent to said fuzzy reasoning portion and used as an element of said fuzzy set for fuzzy reasoning.

8. The defrosting control unit as claimed in claim 7, wherein said situation-reflecting signal generation portion further comprises:

a third temperature sensor for detecting said open air temperature;

a humidity sensor for detecting said open air humidity;

a defrosting time interval computing portion which calculates said optimal defrosting time interval from said open air temperature and said open air humidity and sends said optimal defrosting time interval to a second time difference computing portion that computes said time difference between said post defrosting time and said optimal defrosting time interval, said defrosting time interval computing portion also calculating said marginal defrosting time interval from said open air temperature and said open air humidity and sending said marginal defrosting time interval to a third time difference computing portion that computes said difference between said post defrosting time and said marginal defrosting time interval; and means for deeming said optimal defrosting time interval as a past defrosting time interval result in the absence of the past defrosting time interval result.

9. A defrosting control unit for a showcase unit with an inner duct for circulating air, an evaporator provided in the inner duct to cool the air circulating in the inner duct, a defrosting device attached to the evaporator, the defrosting device having heating means for melting frost which has settled on the evaporator and additionally having a defrosting termination function, and a showcase unit controller connected to the heating means, said defrosting control unit comprising:

a defrosting timer which issues a begin defrosting signal at a predetermined time;

a day/night judgment portion which receives said begin defrosting signal from said defrosting timer and judges whether a present time is daytime or nighttime based on a comparison with preset standard points in time for determining whether said present time is daytime or nighttime; and a defrosting control portion which includes a simple defrosting control portion and a regular defrosting control portion, wherein said day/night judgment portion, upon receipt of said begin defrosting signal from said defrosting timer, generates a simple defrosting control signal if said present time is daytime, or generates a regular defrosting control signal if said present time is nighttime, said simple defrosting control signal being received by said simple defrosting control portion and said regular defrosting control signal being received by said regular defrosting control portion, wherein said simple defrosting control unit sends a defrosting start signal to said showcase unit controller upon receipt of said simple defrosting control signal to start a defrosting operation and then sends a defrosting compulsive end signal to said showcase unit controller at a first time interval, during which substantially no increase in temperature in said showcase unit has occurred, to terminate said defrosting operation compulsively, and wherein regular defrosting control portion sends a defrosting start signal to said showcase unit controller upon receipt of said regular defrosting control signal and then sends a defrosting compulsive end signal to said showcase controller at a second time interval, during which sufficient defrosting occurs and there is no excessive increase in temperature within the showcase unit, to terminate said defrosting operation compulsively if it has not already been terminated by said defrosting termination function of said defrosting device.

10. The defrosting control unit as claimed in claim 9, wherein said second time interval is longer than said first time interval.

11. A showcase system, comprising:

a showcase unit which includes an inner duct for circulating therethrough air for cooling said showcase unit, an evaporator, provided in said inner duct, for cooling the air circulating through said inner duct, a defrosting device attached to said evaporator and having heating means for melting frost which has been deposited on said evaporator, said defrosting device having a defrosting termination function; and a defrosting control unit which includes a situation-reflecting signal generation portion, and a defrosting control portion which receives an output signal from said situation-reflecting signal generation portion and, upon receipt thereof sends said defrosting start signal to said showcase unit controller to start a defrosting operation and, a predetermined time thereafter, sends a defrosting end signal to said showcase unit controller to terminate said defrosting operation if it has not already been terminated by said termination function of said defrosting device, wherein said situation-reflecting signal generation portion includes a fuzzy reasoning portion which employs membership functions and rules to infer an optimal time for starting the defrosting operation based on at least one environmental parameter or value derived therefrom as a fuzzy set, said environmental parameter or value derived therefrom being selected from the group, consisting of (a) am optimum defrosting interval obtained from the temperature and humidity of open air, (b) a marginal defrosting time interval obtained from the temperature and humidity of open air, (c) a stable-state value, the stable-state value being average value of the difference between the temperature of air blown out of said inner duct and the temperature of air immediately after it passes said evaporator over a period after said difference has reached a steady state, (d) a deviation, from said stable-state value, of an actual value of the difference between the temperature of air blown out of said inner duct and the temperature of air immediately after it passes said evaporator, (e) a temporal variation of said deviation, (f) a difference between a post defrosting time and said optimum defrosting interval, and (g) a difference between said post defrosting time and said marginal defrosting time interval, and wherein said output signal of said situation-reflecting signal generation portion reflects a present situation expressed in terms of a result of fuzzy reasoning conducted by said fuzzy reasoning portion.

12. The showcase system as claimed in claim 12, wherein the showcase unit further comprises:

a first temperature sensor for detecting a first air temperature of air blown out from said inner duct; and a second temperature sensor for detecting a second air temperature of air immediately after passing said evaporator, and wherein said situation-reflecting signal generation portion further comprises:

an air temperature difference computing portion which receives data on said first temperature from said first temperature sensor and data on said second temperature from said second temperature sensor, and computes an air temperature difference between said first and second air temperatures;

a stable-state value renewal and store portion which calculates an average of said air temperature difference during a stable period between completion of defrosting and frosting after said completion of defrosting after each defrosting action, and renews and stores said average as said stable-state value;

a deviation computing portion which receives data on said air temperature difference from said air temperature difference computing portion and computes said deviation of said air temperature difference with respect to said stable-state value; and a variation computing portion which receives data on said deviation of said air temperature difference and calculates said temporal variation of said deviation, said temporal variation being sent to said fuzzy reasoning portion and used as an element of said fuzzy set for fuzzy reasoning.

13. The showcase system as claimed in claim 12, wherein said situation-reflecting signal generation portion further comprises:

a post-defrosting time counter which counts the time that has passed from a previous defrosting operation; and a time difference computing portion which computes a time difference between said post-defrosting time and a past defrosting time interval which has been stored, said time difference being sent to said fuzzy reasoning portion and used as a element of said fuzzy set for fuzzy reasoning.

14. The showcase system as claimed in claim 13, wherein said situation-reflecting signal generation portion further comprises:

a third temperature sensor for detecting said open air temperature;

a humidity sensor for detecting said open air humidity;

a defrosting time interval computing portion which calculates said optimal defrosting time interval from said open air temperature and said open air humidity and sends said optimal defrosting time interval to a second time difference computing portion that computes said time difference between said post defrosting time and said optimal defrosting time interval, said defrosting time interval computing portion also calculating said marginal defrosting time interval from said open air temperature and said open air humidity and sending said marginal defrosting time interval to a third time difference computing portion that computes said difference between said post defrosting time and said marginal defrosting time interval; and means for deeming said optimal defrosting time interval as a past defrosting time interval result in the absence of the past defrosting time interval result.

15. The showcase system as claimed in claim 11, wherein said situation-reflecting signal generation portion further comprises a day/night judgment portion which judges whether a present time is daytime or nighttime based on a comparison with predetermined standard points in time for determining whether it is daytime or nighttime;

wherein said defrosting control portion comprises a simple defrosting control portion and a regular defrosting control portion;

wherein said day/night judgment portion, upon receipt of a signal from said fuzzy reasoning unit, generates a simple defrosting signal if said present time is daytime, or generates a regular defrosting control signal if said present time is nighttime, said simple defrosting control signal or said regular defrosting control signal being sent to said defrosting control portion as said output signal of said situation-reflecting signal generation portion, wherein said simple defrosting control portion sends said defrosting start signal to said showcase unit controller Upon receipt of said simple defrosting control signal and then sends said defrosting compulsive end signal to said showcase unit controller at a first time interval during which substantially no increase in temperature occurs to terminate said defrosting operation compulsively; and wherein said regular defrosting control portion sends said defrosting start signal to said showcase unit controller Upon receipt of said regular defrosting control signal and then sends said defrosting compulsive end signal to said showcase unit controller at a second time interval during which sufficient defrosting occurs and there is no excessive increase in temperature.

16. The showcase system as claimed in claim 15, wherein said showcase unit further comprises:

a first temperature sensor for detecting a first air temperature of air blown out from said inner duct; and a second temperature sensor for detecting a second air temperature of air immediately after passing said evaporator, and wherein said situation-reflecting signal generation portion further comprises:

an air temperature difference computing portion which receives data on said first temperature from said first temperature sensor and data on said second temperature from said second temperature sensor, and computes an air temperature difference between said first and second air temperatures;

a stable-state value renewal and store portion which calculates an average of said air temperature difference during a stable period between completion of defrosting and frosting after said completion of defrosting after each defrosting action, and renews and stores said average as said stable-state value;

a deviation computing portion which receives data on said air temperature difference from said air temperature difference computing portion and computes said deviation of said air temperature difference with respect to said stable-state value; and a variation computing portion which receives data on said deviation of said air temperature difference and calculates said temporal variation of said deviation, said temporal variation being sent to said fuzzy reasoning portion and used as an element of said fuzzy set for fuzzy reasoning.

17. The showcase system as claimed in claim 16, wherein said situation-reflecting signal generation portion further comprises:

a post-defrosting time counter which counts the time that has passed from a previous defrosting operation; and a time difference computing portion which computes a time difference between said post-defrosting time and a past defrosting time interval which has been stored, said time difference being sent to said fuzzy reasoning portion and used as a element of said fuzzy set for fuzzy reasoning.

18. The showcase system as claimed in claim 17, wherein said situation-reflecting signal generation portion further comprises:

a third temperature sensor for detecting said open air temperature;

a humidity sensor for detecting said open air humidity;

a defrosting time interval computing portion which calculates said optimal defrosting time interval from said open air temperature and said open air humidity and sends said optimal defrosting time interval to a second time difference computing portion that computes said difference between said post defrosting time and said optimal defrosting time interval, said defrosting time interval computing portion also calculating said marginal defrosting time interval from said open air temperature and said open air humidity and sending said marginal defrosting time interval to a third time difference computing portion that computes said difference between said post defrosting time and said marginal defrosting time interval; and means for deeming said optimal defrosting time interval as a past defrosting time interval result in the absence of the past defrosting time interval result.

19. A showcase system, comprising a showcase unit having an inner duct for circulating air, an evaporator provided in the inner duct to cool the air circulating in the inner duct, a defrosting device attached to the evaporator, the defrosting device having heating means for melting frost which has settled on the evaporator and additionally having a defrosting termination function, and a showcase unit controller connected to the heating means;

a defrosting timer which issues a begin defrosting signal at a predetermined time;

a day/night judgment portion which receives said begin defrosting signal from said defrosting timer and judges whether a present time is daytime or nighttime based on a comparison with preset standard points in time for determining whether said present time is daytime or nighttime; and a defrosting control portion which includes a simple defrosting control portion and a regular defrosting control portion, wherein said day/night judgment portion, upon receipt of said begin defrosting signal from said defrosting timer, generates a simple defrosting control signal if said present time is daytime, or generates a regular defrosting control signal if said present time is nighttime, said simple defrosting control signal being received by said simple defrosting control portion and said regular defrosting control signal being received by said regular defrosting control portion, wherein said simple defrosting control unit sends a defrosting start signal to said showcase unit controller upon receipt of said simple defrosting control signal to start a defrosting operation and then sends a defrosting compulsive end signal to said showcase unit controller at a first time interval, during which substantially no increase in temperature in said showcase unit has occurred, to terminate said defrosting operation compulsively, and wherein regular defrosting control portion sends a defrosting start signal to said showcase unit controller upon receipt of said regular defrosting control signal and then sends a defrosting compulsive end signal to said showcase controller at a second time interval, during which sufficient defrosting occurs and there is no excessive increase in temperature within said showcase unit, to terminate said defrosting operation compulsively if it has not already been terminated by said defrosting termination function of said defrosting device.

20. The showcase system as claimed in claim 19, wherein said second time interval is longer than said first time interval.

* * * * *